US007657199B2

(12) United States Patent
Nishikawa

(10) Patent No.: US 7,657,199 B2
(45) Date of Patent: Feb. 2, 2010

(54) IMAGE FORMING APPARATUS WITH AIR BLOWING UNIT AND ASSOCIATED TRANSFER BIAS CHANGING MEANS

(75) Inventor: Akihiro Nishikawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 192 days.

(21) Appl. No.: 11/687,222

(22) Filed: Mar. 16, 2007

(65) Prior Publication Data

US 2007/0286627 A1 Dec. 13, 2007

(30) Foreign Application Priority Data

Mar. 30, 2006 (JP) ..... 2006-094188

(51) Int. Cl.
*G03G 15/16* (2006.01)
*G03G 21/20* (2006.01)

(52) U.S. Cl. ..... 399/66; 399/101; 399/297; 271/10.01; 271/11

(58) Field of Classification Search ..... 399/66, 399/101, 91, 154, 297, 308; 271/10.01, 11
See application file for complete search history.

(56) References Cited

U.S. PATENT DOCUMENTS 6,009,285 A * 12/1999 Barry et al. ..... 399/12
6,009,286 A * 12/1999 Watanabe et al. ..... 399/44
6,015,144 A 1/2000 Yoshii et al. ..... 271/97
6,345,168 B1 * 2/2002 Pitts ..... 399/314
2005/0067757 A1 * 3/2005 Suga et al. ..... 271/98

FOREIGN PATENT DOCUMENTS

| | | |
|---|---|---|
| JP | 1-265282 | 10/1989 |
| JP | 4-94337 A | 3/1992 |
| JP | 9-058902 | 3/1997 |
| JP | 9-197734 | 7/1997 |
| JP | 11-005643 | 1/1999 |
| JP | 2000-155448 A | 6/2000 |
| JP | 2001-048366 | 2/2001 |
| JP | 2004-118019 | 4/2004 |
| JP | 2005-330079 | 12/2005 |

* cited by examiner

*Primary Examiner*—David M Gray
*Assistant Examiner*—G. M. Hyder
(74) *Attorney, Agent, or Firm*—Fitzpatrick, Cella, Harper & Scinto

(57) ABSTRACT

An image forming apparatus including an image bearing member which bears a toner image; a transfer unit which transfers the toner image on the image bearing member to a transfer portion when applied with transfer voltage; a recording material feeding unit which includes a stacking portion where recording materials are stacked and an air blowing device for blowing air to the recording material stacked in the stacking portion, and feeds the recording material to the transfer portion; and a transfer bias control portion which controls the transfer bias according to at least one of air received time per one sheet by the air blowing unit, air pressure and air temperature is provided.

6 Claims, 22 Drawing Sheets

TRANSFERABILITY OF SECONDARY COLOR LOWERS
THEREBY PRODUCING DEFECTED IMAGE
WHEN CONTINUOUSLY APPLYING SAME TRANSFER BIAS

TRANSFERABILITY OF SECONDARY COLOR LOWERS THEREBY PRODUCING DEFECTED IMAGE WHEN CONTINUOUSLY APPLYING SAME TRANSFER BIAS

IMAGE FORMING APPARATUS WITH AIR BLOWING UNIT AND ASSOCIATED TRANSFER BIAS CHANGING MEANS

BACKGROUND OF THE INVENTION

1. Field of the Invention

The present invention relates to an image forming apparatus including a feeding device for feeding a recording material by blowing air to the recording material, and a transfer device for electrostatically transferring a toner image onto the recording material.

2. Description of the Related Art

Conventional image forming apparatus such as copying machine, printer and the like includes a sheet feeding device for sequentially feeding the sheets stacked on a sheet stacking portion one by one starting from the sheet at the top by means of a pickup roller, and thereafter, separating the sheets one by one by means of a separating portion and feeding the sheet to an image forming portion.

Cut sheets are used when successively feeding the sheets in such sheet feeding device, but such cut sheets are normally limited to quality paper or plain paper recommended by the copying machine manufacturing company. Various separation methods have been conventionally used to reliably separate and feed the sheets one at a time. The various methods include a separation pad method of contacting a friction member to the feed roller at a predetermined pressure to prevent feeding in overlapped manner.

In another separating method, or the retard separating method, the separating portion is configured by a feed roller that rotates in a sheet conveying direction, and a separation roller that is driven in a direction opposite the sheet conveying direction at a predetermined torque and that contacts the feed roller at a predetermined pressure. In the retard separating method, only the top sheet of the sheet stack sent out by the pick up roller is passed, and the other sheet fed along with the top sheet is returned to the sheet stacking unit side by the separating portion to prevent feeding in overlapped manner.

The sheets are reliably separated one by one by optimizing the return torque and the pressurizing force of the separation roller in consideration of the frictional force of the sheets to be fed to reliably separate and feed the sheets in such separating methods, for example, in the retard separating method.

Recently, request to form images on the sheets such as coated paper, which surface is performed with coating process to give whiteness and glaze from demands of the market of colorization, is increasing in addition to super thick paper, OHP sheet, art film with diversification of the sheets (recording material, recording medium).

However, when feeding super thick papers, the weight of the super thick paper acts as resistance in conveying, and the sheets get jammed as they cannot be picked up. The surface of the sheets made of resin material that are easily charged such as OHP sheet and art film is gradually charged when the sheets are rubbed against each other in the feeding operation under low humidity environment. Since the sheets attach to each other by Coulomb force, the sheets may not be picked up or may be fed in overlapped manner.

The coated sheets with coating material including paint applied to the surface of the paper have a property of attaching to each other particularly when stacked in an environment of high humidity, and thus may not be picked up or may be frequently fed in overlapped manner.

This is because in cases of special sheets such as the above, the frictional force itself of the sheets is equal to or less than plain paper, but the absorption force is high. That is, the sheets are absorbed to each other at a force much higher than the frictional force of the sheets by the absorption force due to the friction charge under low humidity environment in the case of resin material sheet, or by absorption force under high humidity environment in the case of coated sheets, and thus the sheets may not be adequately separated with the conventional separating method.

That is, since only the frictional force between the sheets is considered in the conventional separating method, the sheets cannot be reliably separated if absorption force other than the frictional force is acting.

The separating and feeding method using air separation is adopted in printing industry and some copying machines to release the very high absorption force between the sheets. This is a method of separating the sheets in advance by blowing air from the side face of the sheet stack, picking up the sheets one by one from the top sheet with the absorption between the sheets removed, and separating the sheets one by one at the separating portion arranged at the downstream (Japanese Patent Application Laid-Open No. 11-005643).

The sheets are separated to release the absorption prior to feeding even for sheets having high absorption force in the separating and feeding method equipped with a unit for blowing air from the side face of the sheet stack, as described above, and thus the separation performance enhances compared to the method of using only the friction force as previously described.

The separating and feeding methods in which the air is blown from the side face of the sheet stack includes a method of dehumidifying the sheet by heating the blown air with heater and reducing the absorption force of the coated paper and the like particularly under the high humidity environment (Japanese Patent Application Laid-Open No. 2001-48366).

However, in the feeding device adopting the separating and feeding method of blowing air such as the above, the moisture content of the sheet gradually changes when air is blown. With change in moisture content, the transfer performance with respect to the application bias changes in a secondary transfer portion, and image defect occurs from the middle of the job. In particular, the transfer performance is greatly influenced by the resistance value of the sheet in the electrophotographic method in which the image forming portion transfers the toner image to the sheets using static electricity. Thus, when the resistance value varies in the sheets, transfer becomes uneven, and degradation of image caused therefrom becomes significant, whereby the problem regarding image quality arises.

SUMMARY OF THE INVENTION

The present invention aims to provide an image forming apparatus for reducing image defects such as transfer defect even when using the feeding device adopting the separating and feeding method of blowing air.

The present invention also aims to provide an image forming apparatus including, an image bearing member which bears a toner image;

a transfer unit which transfers the toner image on the image bearing member in a transfer portion when applied with transfer voltage;

a recording material feeding unit which includes a stacking portion where recording materials are stacked and an air blowing unit for blowing air to the recording material stacked in the stacking portion, and feeds the recording material to the transfer portion; and a transfer bias control portion which controls the transfer bias according to at least one of air received time per one sheet by the air blowing unit, air pressure and air temperature.

DESCRIPTION OF THE EMBODIMENTS

Figure 1:
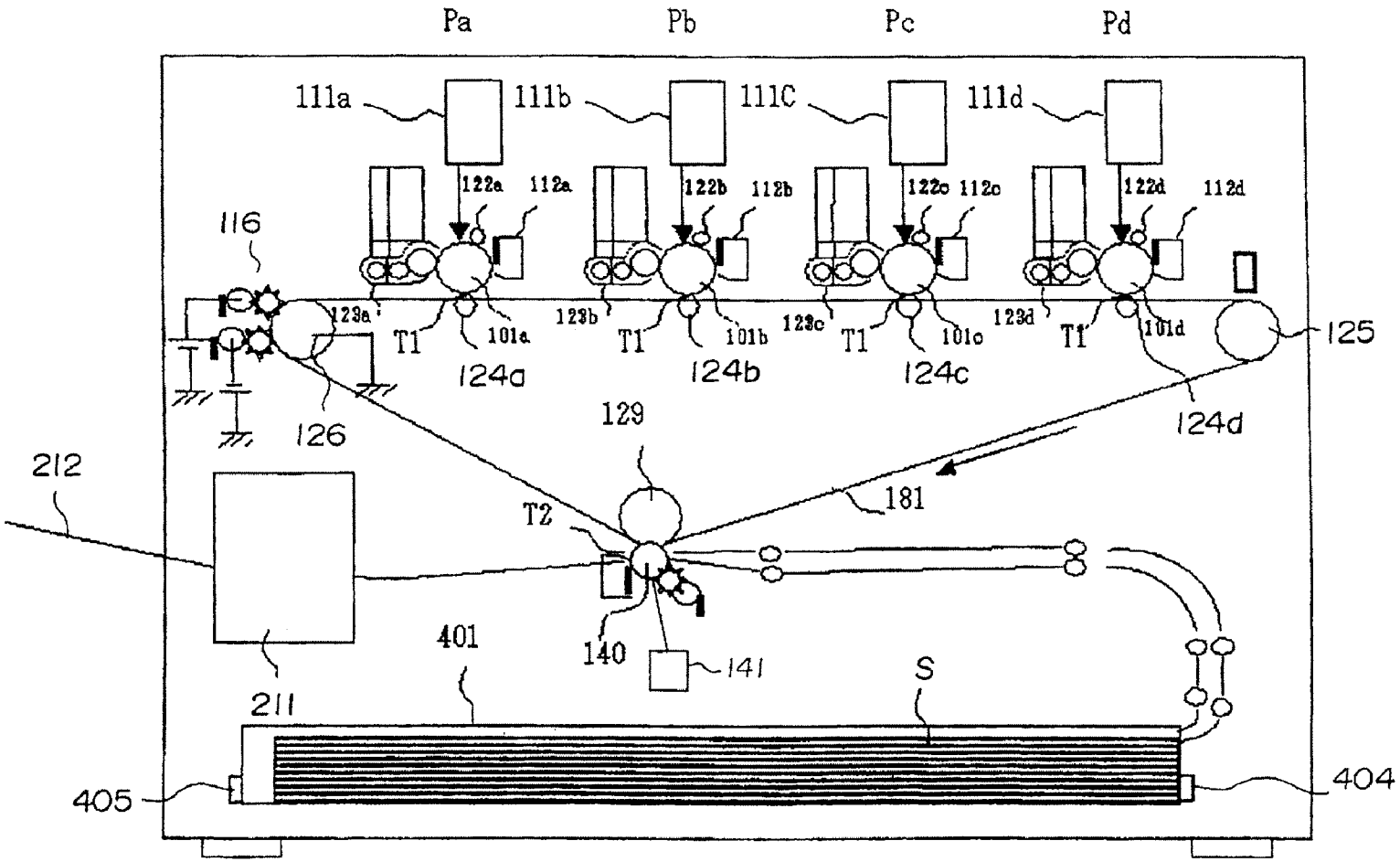
FIG. 1 is a cross sectional view illustrating an image forming apparatus.

The image forming apparatus according to one embodiment of the present invention will now be specifically described with reference to the drawings.

First Embodiment

The present embodiment relates to a tandem image forming apparatus equipped with an image bearing member including four photosensitive members.

{Entire Configuration of Image Forming Apparatus}

First, the entire configuration of the image forming apparatus will be described with the image forming operation. Each image forming portion Pa, Pb, Pc, Pd forming the color toner image of yellow, magenta, cyan and black are arranged substantially horizontally from the left of FIG. 1 in the image forming apparatus of the present embodiment. Each image forming portion has the same configuration other than that the color of the toner is different. The following description is given omitting the reference numerals a, b, c, and d denoted in the figures.

The image forming apparatus of the present embodiment includes a belt shaped elastic intermediate transfer member, that is, an endless elastic intermediate transfer 181, as shown in FIG. 1. The intermediate transfer belt 181 is winded to a drive roller 125, a tension roller 126 and a backup roller 129 serving as supporting members. Four image forming portions P are linearly arranged along the horizontal part of the intermediate transfer belt 181.

Each image forming portion P includes an electro-photographic photosensitive member of drum shape (hereinafter referred to as "photosensitive drum") serving as an image bearing member arranged in a rotatable manner. Processing units such as primary charging roller 122, development device 123, and cleaning device 112 are arranged around the photosensitive drum 101.

Yellow toner, magenta toner, cyan toner and black toner are respectively accommodated in the development device 123 arranged in each image forming portion Pa to Pd.

The photosensitive drum 101 is uniformly charged to negative polarity by the primary charging roller 122, and an image signal is projected onto the photosensitive drum 101 via a polygonal mirror from an exposure device 111 to form an electrostatic latent image. The toner is then supplied from the development device 123, and the electrostatic latent image is developed as toner image. When the toner image reaches a primary transfer portion T1 at where the photosensitive drum 101 and the intermediate transfer belt 181 contact with the rotation of the photosensitive drum 101, a positive transfer bias is applied to the primary transfer roller 124 from a bias power supply (not shown). The toner image of each photosensitive drum 101 is thereby sequentially transferred to the intermediate transfer belt 181 in an overlapped state, thereby forming a color image.

A sheet S serving as a recording material sent out from a paper deck 401 by a sheet feeding device to be hereinafter described is fed to a secondary transfer portion T2 in synchronization with the transfer of the toner image to the intermediate transfer belt 181. The positive transfer bias is then applied to the secondary transfer roller 140 from a bias power supply 141, and the toner image on the intermediate transfer belt 181 is transferred onto the sheet S by the electric field. The method of determining the transfer bias will be hereinafter described.

The sheet S transferred with the toner image is conveyed to a fixing portion 211 at where the toner image is fixed on the sheet S by heat and pressure, and the sheet is discharged to a discharge tray 212.

The transfer residual toner that was not transferred to the intermediate transfer belt 181 from the photosensitive member belt 101 at the primary transfer portion T1 is cleaned by the cleaning device 112. The transfer residual toner that was not transferred to the sheet S from the intermediate transfer belt 181 at the secondary transfer portion T2 is cleaned by a belt cleaning device 116.

{Sheet Feeding Device}

The sheet feeding device (recording material feeding unit) for feeding the sheet (recording material) to the secondary transfer portion T2 will now be described. The sheet feeding device in the present embodiment employs a separating and feeding method of air feeding type.

Figure 2:
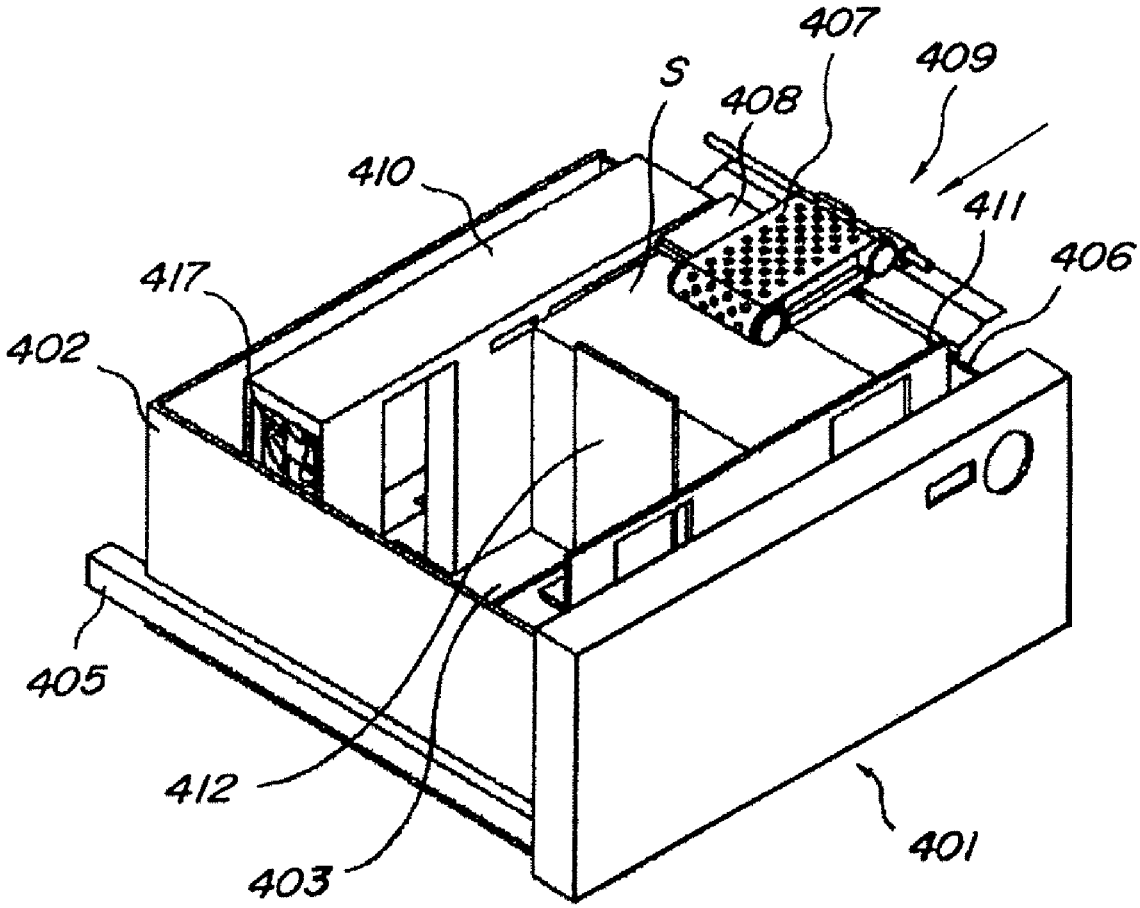
FIG. 2 is a perspective view illustrating a paper deck.

FIG. 2 illustrates a perspective view illustrating the paper deck 401. The paper deck 401 stores in stacking manner the sheet stack S on a middle plate 403 or a sheet stacking part arranged in the storage 402 in a rising and lowering manner. Rails 404, 405 (rail 404 is shown in FIG. 1) are arranged at the lower edge of both sides of the storage 402, thereby allowing the storage 402 to be pulled towards the front side (direction of front of paper of FIG. 1) with respect to the device main body. The sheet stack S stacked and stored in the storage 402 has the front end (end of the downstream side in sheet feeding direction) regulated by a pre-separating plate 406 and the back end (end on upstream side in sheet feeding direction) regulated by a back end regulating plate 412. The side ends of the sheet are regulated to a predetermined position by side regulating plates 410, 411.

A sheet feeding portion 409 serving as a sheet absorbing and conveying unit for absorbing and sending out the top sheet by air is arranged on the downstream side in the sheet feeding direction of the stacked sheet stack S. The sheet feeding portion 409 includes an intake duct 408, coupled to an intake unit (not shown) for generating intake static pressure at above the sheet stack, and an absorbing belt 407 with a great number of holes arranged so as to surround the intake duct 408 is arranged feed rotatable in the sheet feeding direction.

The sheet is absorbed to the absorbing belt 407 by the intake duct 408 and the sheet is fed by rotating the absorbing belt 407 in the sheet feeding portion 409.

(Air Blowing Unit)

The sheet feeding device of the present embodiment blows air to the side face of the sheet stack stacked in the sheet stacking portion by an air blowing unit to separate the sheet stack, and separate and feed the sheets. The configuration of the air blowing unit will now be described with reference to FIGS. 3A to 3D. FIGS. 3A to 3D are cross sectional views illustrating the air blowing unit when FIG. 2 is viewed from the sheet feeding direction.

The air pressure subjected by one sheet and the time for receiving air (air received time) are changed depending on the basis weight and the surface property of the sheet. In other words, the rotation number of the blowing fan 417 is increased to increase the air pressure to respond to the weight of the sheet when the basis weight of the sheet is large. On the other hand, the rotation number of the blowing fan 417 is decreased to reduce the air pressure to prevent sheets from wrinkling by air when the basis weight of the sheet is small. The air pressure is set high when using sheets which surface has high attracting force such as coated paper. Since the number of sheets that are subjected to air by one blow increases when the basis weight of the sheet is small, the total time for receiving air until the sheets stacked on the paper deck 401 are fed becomes longer. The temperature of the air sent by the blowing fan 417 changes according to ambient temperature.

An air blowing unit is arranged inside the side regulating plate 410. The air blowing unit includes the blowing fan 417 (shown in FIG. 2), which is the supply source of air, and a blowing duct 413 coupled to the fan 417 and having one end including an opening 414 opened towards the side end of the sheet stack S stacked and stored in the storage 402. Thus, the air is blown from the opening 414 towards the side end of the sheet stack S to separate the sheets. The air supply source of the air blowing unit may be fans such as Sirocco fan, or a compressor may be used.

Figure 3A:
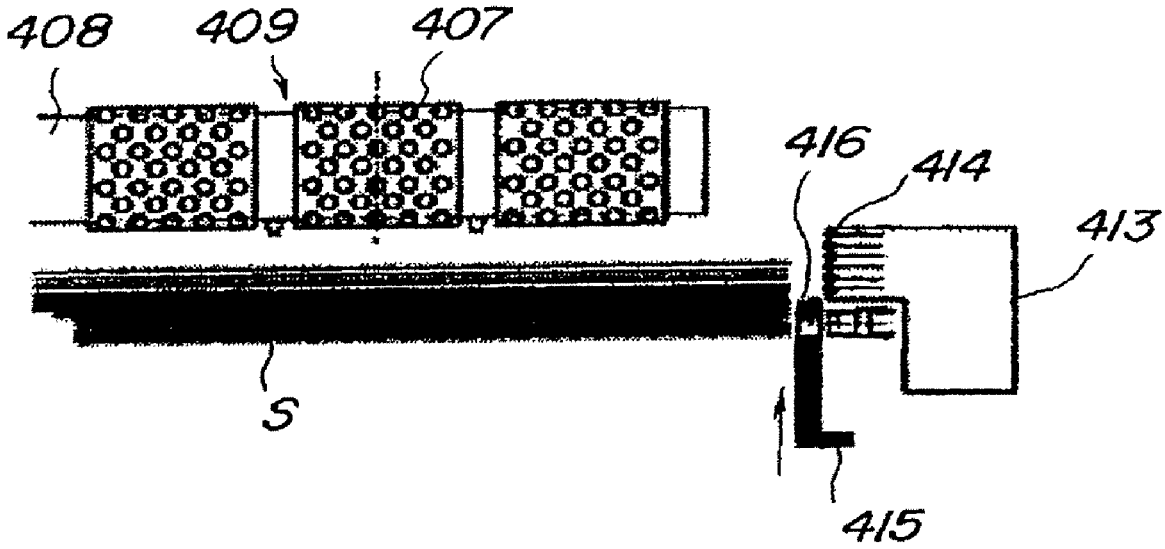
FIGS. 3A to 3D are cross sectional views illustrating an air blowing unit when viewed from a sheet feeding direction.
Figure 3B:
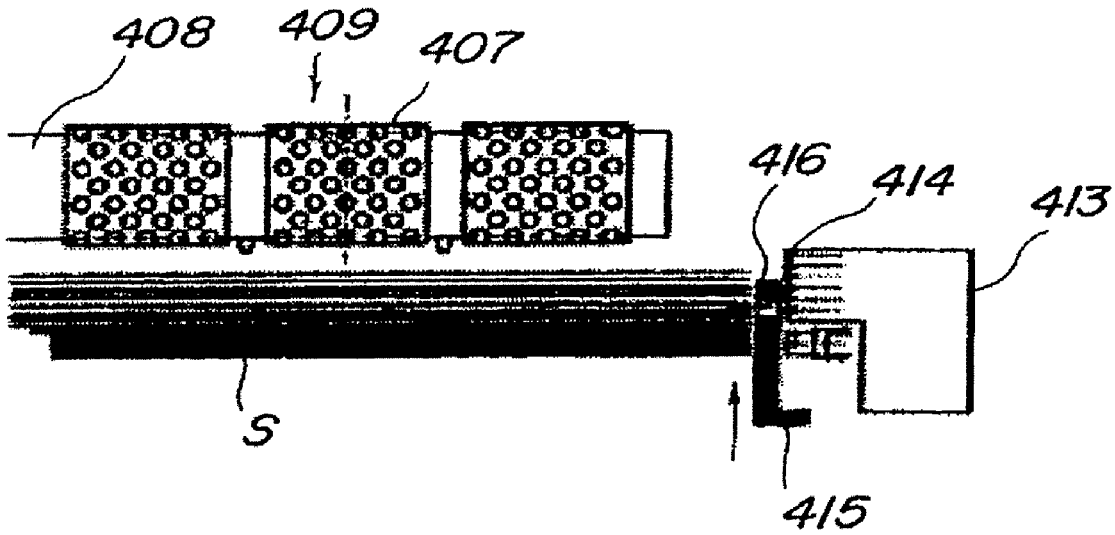
Figure 3C:
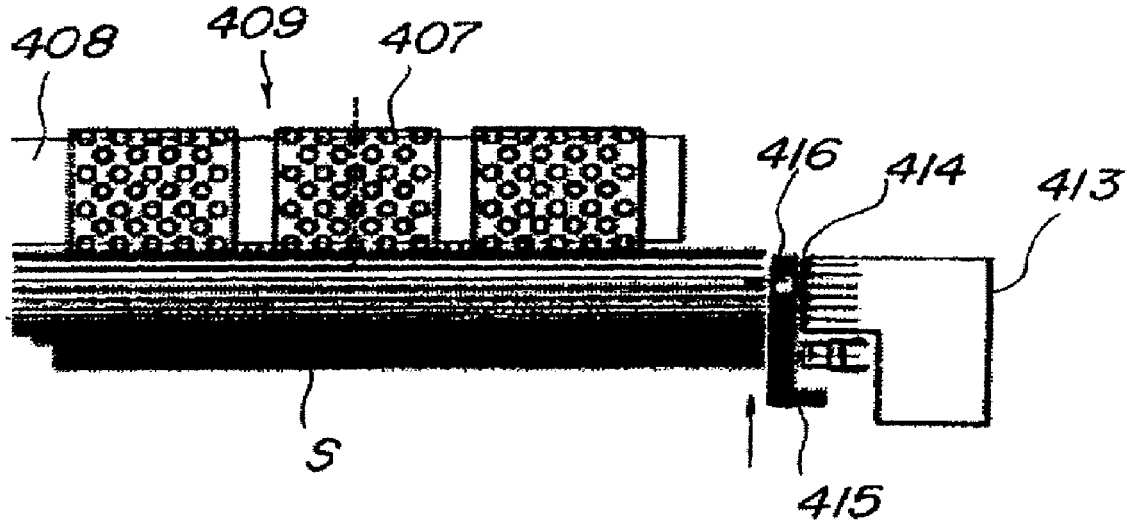
Figure 3D:
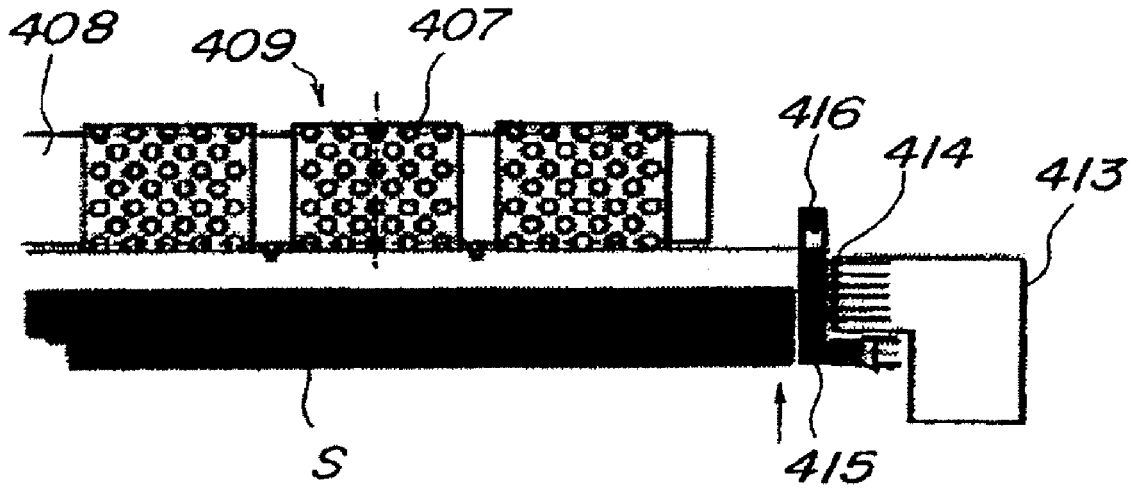
Figure 4:
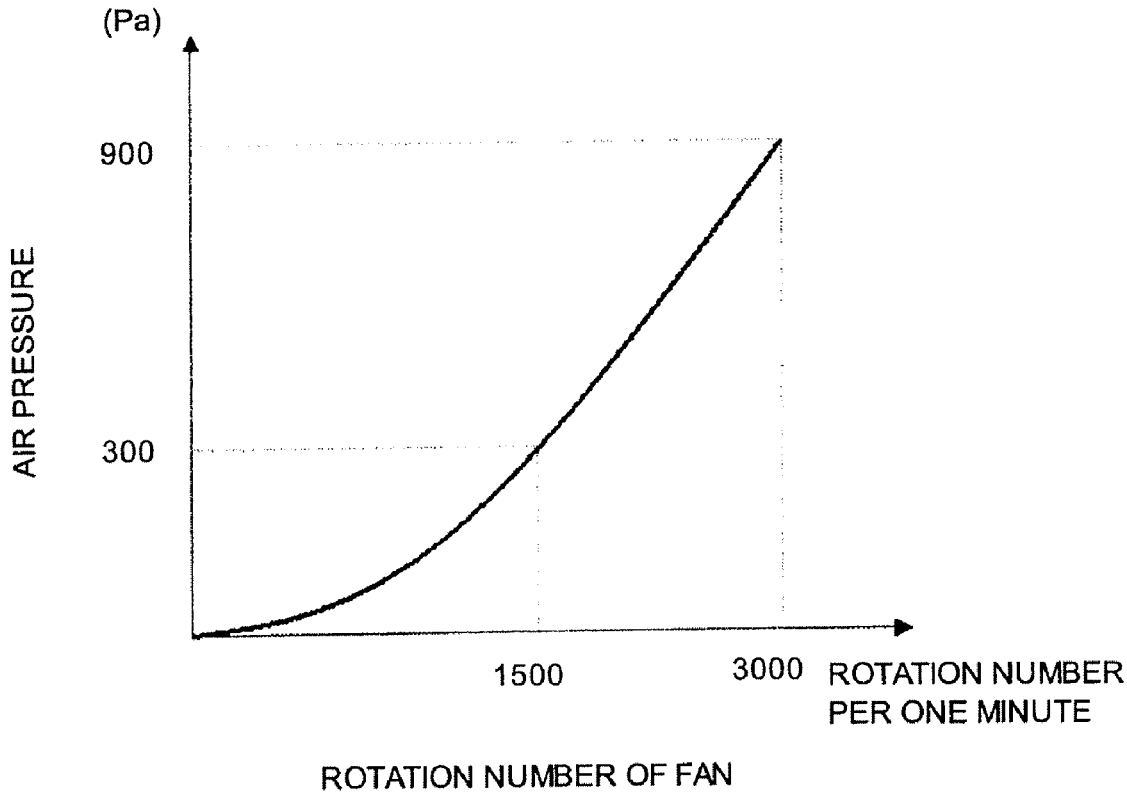
FIG. 4 is a view illustrating the relationship between rotation number of the fan and air pressure.

Furthermore, a shutter 415 serving as a unit for changing the time to be subjected to air is arranged between the side end of the sheet stack S and the opening 414 so as to be movable by a driving source (e.g., motor, solenoid) (not shown) in a substantially vertical direction, as shown in FIGS. 3A to 3D. The air can be blown from a shutter opening 416 towards the side face of the stacked sheet stack by moving the shutter 415 upward. The air does not hit the side face of the stacked sheet stack if the shutter opening 416 and the opening 414 of the blowing duct 413 are misaligned, as shown in FIG. 3D. Therefore, the time for blowing air to the stacked sheet stack, that is, the air received time can be adjusted by raising and lowering (opening and closing) the shutter 415. The air pressure is adjustable by controlling the rotation number of the blowing fan 417, as shown in FIG. 4.

(Transfer Bias Changing Unit)

The method of determining the transfer bias Vt of the image forming apparatus of the present embodiment will now be described. The transfer voltage Vt is obtained as the sum of the divided voltage Vb of the secondary transfer portion T2 and the divided voltage Vp of the recording material P.

The resistance variation in time of manufacturing is difficult to suppress in the secondary transfer roller 140, and the resistance tends to change due to change in temperature and humidity of the ambient environment, lowering in durability. The current value at which a predetermined voltage is applied to the secondary transfer roller 140 at a timing other than in the normal secondary transfer is detected to obtain the divided voltage vb of the secondary transfer portion T2.

Figure 5:
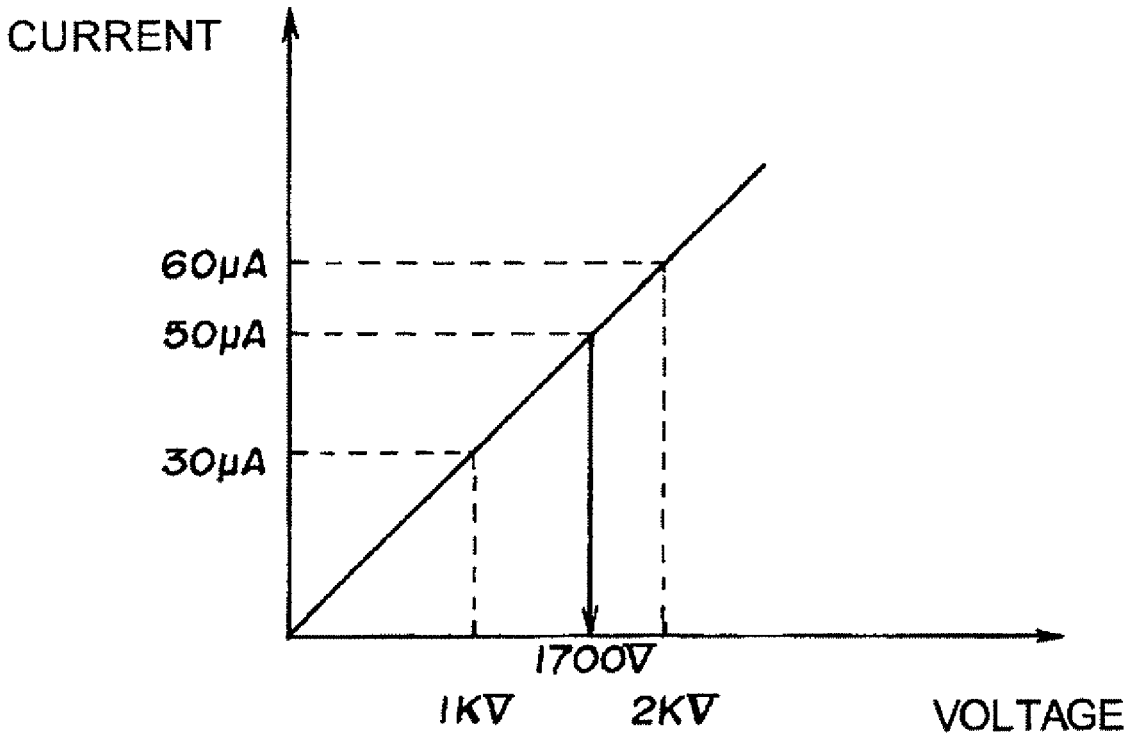
FIG. 5 is a view illustrating the current when voltage is applied to a secondary transfer roller.

The sheets are influenced by the blowing air in the paper deck 401, and the moisture content of the sheets lower. If the same bias value transfer bias is applied in the secondary transfer portion, as shown in FIG. 5, transfer defect may occur in which the transferability due to mismatch of the transfer bias lowers thereby producing defected image.

A bias changing unit for correcting the divided voltage Vp of the recording material P defined in advance based on the temperature of the air, air volume, and the time for receiving air (air received time) received by one sheet is arranged.

The method of determining the divided voltage Vb of the secondary transfer portion T2 will be described in detail first. The intermediate transfer belt 181 is rotated when secondary transfer is not being performed, and +1 kV, +2 kV are applied as monitor voltages to the secondary transfer roller 140. The current value flowing through the secondary transfer roller 140 at this time is detected by a current detector 204.

A target current value of a current value to be flowed to the secondary transfer roller 140 to perform satisfactory secondary transfer is stored in a memory 205 in advance. The transfer bias control portion 203 obtains the divided voltage Vb of the secondary transfer portion T2 for flowing the target current value based on the detected result of the current detector 204. In the present example, the current value when +1 kV is applied is 30 μA, and the current value when +2 kV is applied is 60 μA. According to such relationship, the voltage-current value relationship shown in FIG. 5 is obtained. 1700V is obtained as Vb corresponding to the target current value 50 μA of the present example based on the relationship in FIG. 5.

The method of determining the divided voltage Vp of the recording material P will now be described.

Figure 6:
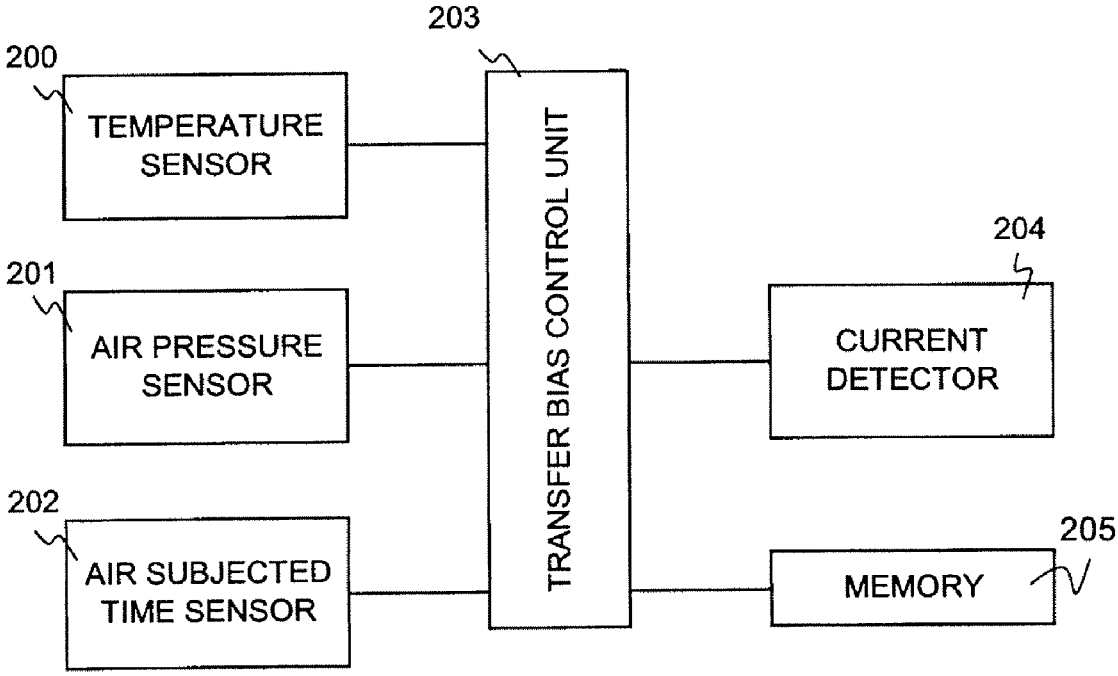
FIG. 6 is a block diagram illustrating a control configuration for changing a transfer bias.

Specifically, the bias changing unit includes a temperature sensor 200 for detecting the temperature of the blowing air, and an air pressure sensor 201 for detecting the air pressure of the blowing air, as shown in FIG. 6. Furthermore, an air received time sensor 202 for detecting the air received time of the stacked sheet stack according to the rising and lowering of the shutter 415 is also arranged. Table 1 is a table showing the relationship between the types of sheets and the divided voltage Vp of the sheet.

TABLE 1

| Type of sheet | Divided voltage of sheet Vp |
|---|---|
| Plain paper (basis weight: 80 g) | 500 V |
| Plain paper (basis weight: 209 g) | 700 V |
| Coated paper (basis weight: 209 g) | 900 V |

A transfer bias control portion 203 for receiving the detection signal of each sensor and changing the transfer bias based on the detected result is arranged. The air pressure changes with the rotation number of the blowing fan 417, as shown in FIG. 4, and the air pressure sensor 201 detects the air pressure from the rotation number of the blowing fan 417. The air pressure shown in FIG. 4 was measured using Climomaster anemoeter (Model 6551) manufactured by KANOMAX Corporation.

Figure 7:
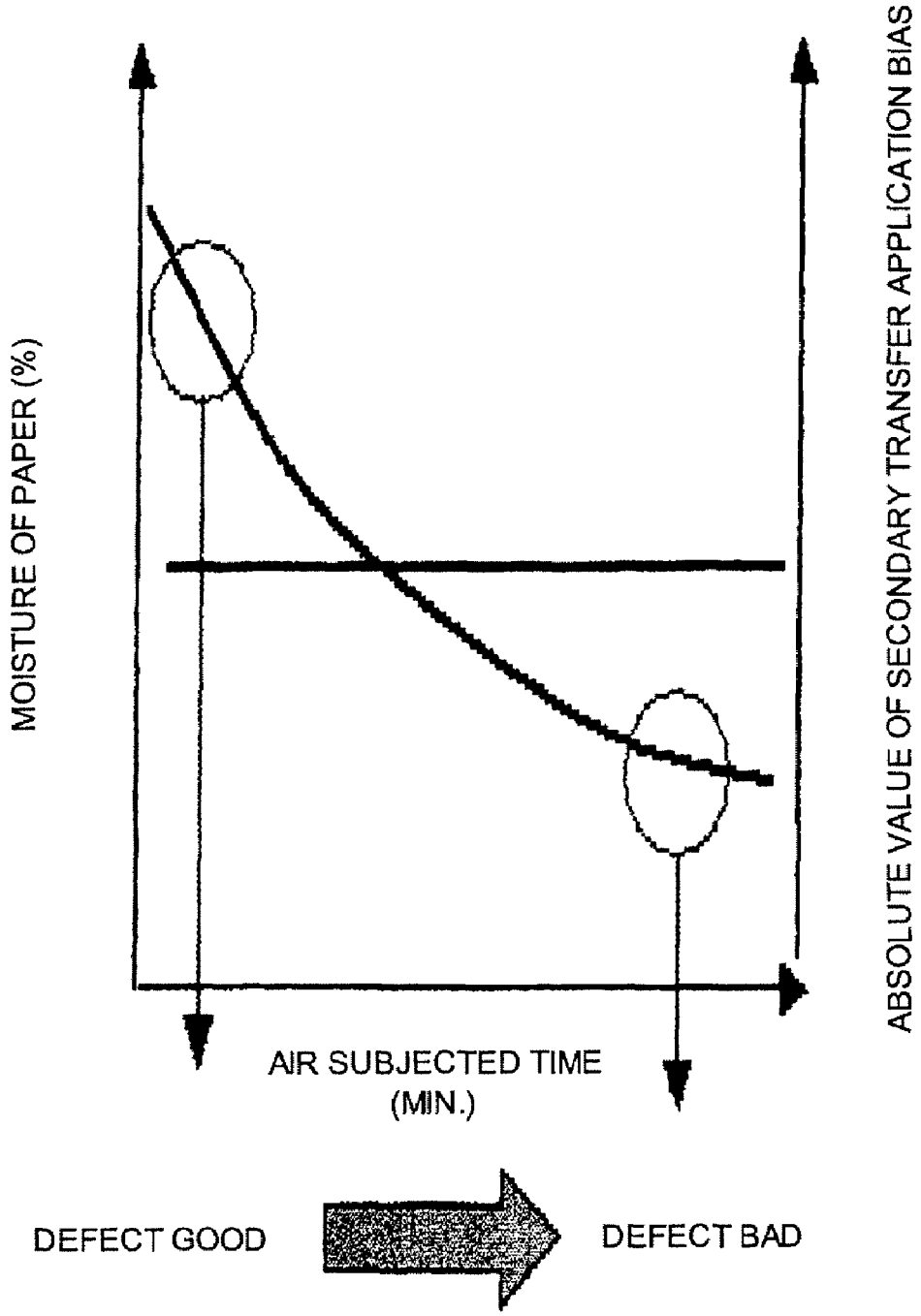
FIG. 7 is a simplified view of moisture content and transfer bias.
Figure 8:
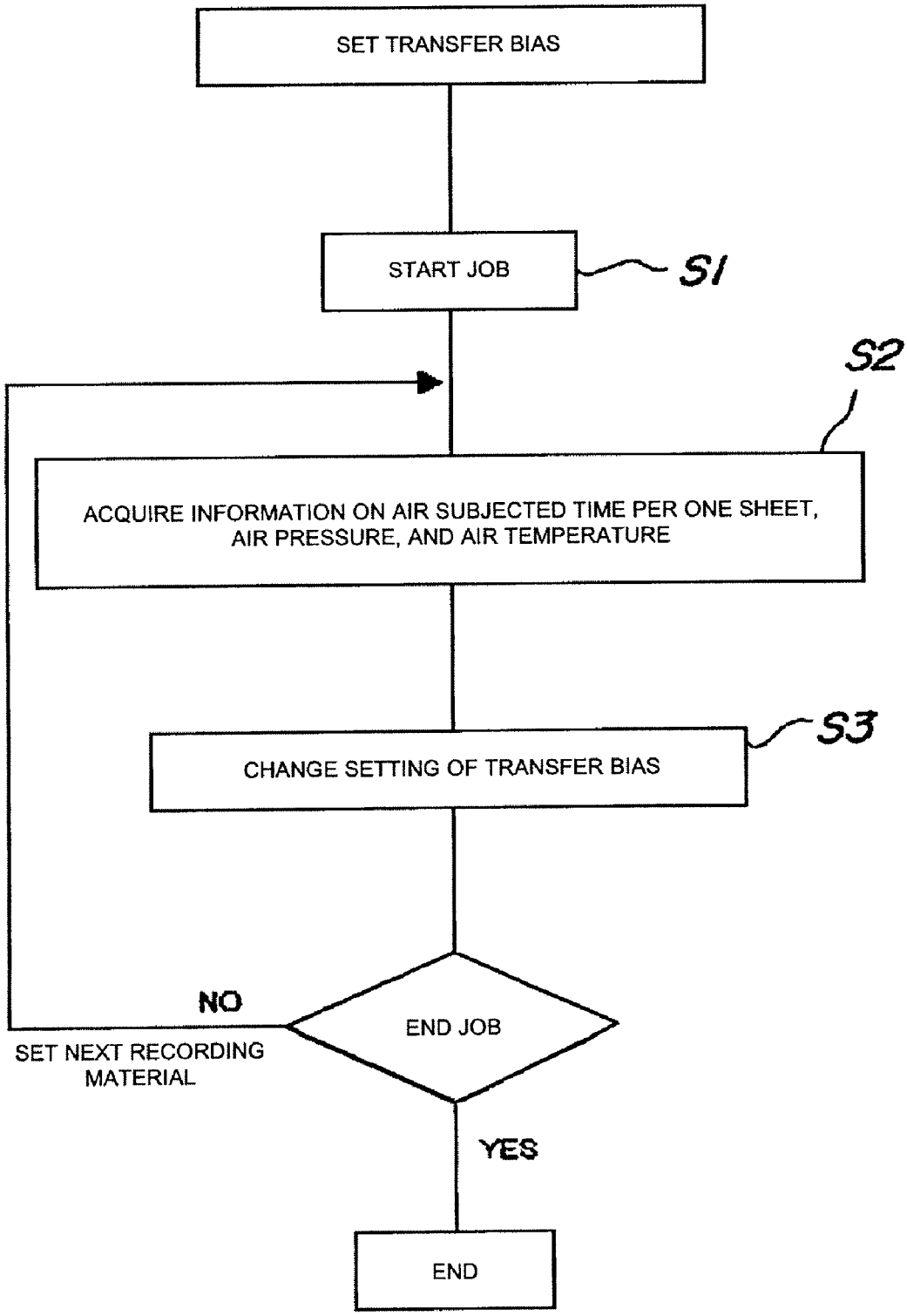
FIG. 8 is a control flow chart for changing the transfer bias in examples 1 to 3.

The divided voltage Vp of the sheet is increased (absolute value, hereinafter expressed in the same manner) and the transfer bias to be applied to the secondary transfer roller 140 is increased with lowering in the moisture content, as shown in FIG. 7. Specifically, when the job of image recording is started (S1), the information on the air received time per one sheet blown with air by the blowing fan 417, the air pressure, and the air temperature are acquired (S2), as shown in FIG. 8. An appropriate correction value is added to the divided voltage Vp based on such information to change the secondary transfer bias value (S3). The secondary transfer bias having a value suited for the moisture content of the sheet is then applied, thereby preventing image defect.

Specific examples of the values of the transfer bias in the secondary transfer portion when the air pressure and the air received time by the blowing fan 417 are changed in the image forming apparatus of the present embodiment will now be described using tables 2 and 3. Tables 2 and 3 are tables showing the relationship between air pressure, air received time, air temperature, and the correction value.

TABLE 2

| Air temperature: 25° C. | | | | |
|---|---|---|---|---|
| | | Air received time (sec.) | | |
| | | 2 | 3 | 4 |
| Air pressure (Pa) | 400 | 20 V | 30 V | 40 V |
| | 600 | 30 V | 45 V | 60 V |
| | 800 | 40 V | 60 V | 80 V |

TABLE 3

| Air temperature: 40° C. | | | | |
|---|---|---|---|---|
| | | Air received time (sec.) | | |
| | | 2 | 3 | 4 |
| Air pressure (Pa) | 400 | 15 V | 20 V | 30 V |
| | 600 | 20 V | 32 V | 40 V |
| | 800 | 30 V | 40 V | 60 V |

In the image forming apparatus of the present embodiment, the air is blown for two seconds to the vicinity of the top part of the sheet stack each time one sheet is to be fed from the sheet stack stacked on the paper deck 401. The height the sheet stack receives air is maintained constant in the height direction of the sheet stack. Therefore, the number of sheets (number of floating sheets) blown with air to feed one sheet from the sheet stack increases as the sheets become thinner (the basis weight become smaller), and the time blown with air until the sheet is fed, that is, the air received time becomes longer.

The air pressure and the number of floating sheets or the sheets that are influenced by air during the job have, in advance, set values in the main body for each types of sheets, as shown in table 4. Table 4 is a table showing the relationship between the types of sheet and the number of floating sheets.

TABLE 4

| Type of sheet | Number of floating sheets |
|---|---|
| Plain paper (basis weight: 80 g) | 20 sheets |
| Plain paper (basis weight: 209 g) | 10 sheets |
| Coated paper (basis weight: 209 g) | 10 sheets |

The relationship between the air received time, the air pressure, the air temperature and the correction value are as shown in tables 2 and 3. As described above, the air is blown for two seconds to the vicinity of the top part of the sheet stack irrespective of the types of sheets each time one sheet is to be fed from the sheet stack. Therefore, the air received time of the top of sheet is two seconds. The air is blown to the second sheet from the top twice until the sheet is fed, and thus the air received time is four seconds. Similarly, two seconds are added to the air received time each time the position of the sheet lowers by one sheet. Two seconds are added until the position of the sheet reaches the number of floating sheets.

I. When Air Temperature is 25° C.

(1) for Sheet of Plain Paper Having Basis Weight of 80 g

The air pressure is set to 400 Pa. The number of floating sheets is twenty. The correction value to be added to the divided voltage Vp of the sheet is increased by +20V each time the air received time increases two seconds. The divided voltage Vp of the plain paper having basis weight of 80 g is 500V. Therefore, the divided voltage Vp of the sheet at the top of the sheet stack, which air received time is two seconds, is +520V (=500V+20V). The divided voltage Vp of the second sheet from the top of the sheet stack, which air received time is four seconds, is +540V (=500V+20V×2).

(2) for Sheet of Plain Paper Having Basis Weight of 209 g

The air pressure is set to 600 Pa. The number of floating sheets is ten. The correction value to be added to the divided voltage Vp of the sheet is increased by +30V each time the air received time increases two seconds.

(3) for Sheet of Coated Paper Having Basis Weight of 209 g

The air pressure is set to 800 Pa. The number of floating sheets is ten. The correction value to be added to the divided voltage Vp of the sheet is increased by +40V each time the air received time increases two seconds.

II. When Temperature of the Air is 40° C., the Following Control is Performed According to Table 3.

(1) for Sheet of Plain Paper Having Basis Weight of 80 g

The air pressure is set to 400 Pa. The number of floating sheets is twenty. The correction value to be added to the divided voltage Vp of the sheet is increased by +30V each time the air received time increases two seconds.

(2) For Sheet of Plain Paper Having Basis Weight of 209 g

The air pressure is set to 600 Pa. The number of floating sheets is ten. The correction value to be added to the divided voltage Vp of the sheet is increased by +45V each time the air received time increases two seconds.

(3) For Sheet of Coated Paper Having Basis Weight of 209 g

The air pressure is set to 800 Pa. The number of floating sheets is ten. The correction value to be added to the divided voltage Vp of the sheet is increased by +60V each time the air received time increases two seconds.

The air pressure is changed according to the basis weight and the surface property of the sheet in the present example, but the time of blowing air to the vicinity of the top of the sheet stack may be changed each time one sheet is fed from the sheet stack. When the air pressure is fixed at 400 Pa, the blowing time when feeding one sheet of plain paper having basis weight of 80 g is two seconds, three seconds for feeding one sheet of plain paper having basis weight of 209 g, and four seconds for feeding one sheet of coated paper having basis weight of 209 g.

A case of continuous paper passing has been described in the present embodiment. However, in the intermittent mode or when the user adds sheets in the middle, a sheet surface position detecting sensor arranged in the main body stores the time the sheets are placed in the paper deck and the current sheet surface position, and the transfer bias is controlled in the transfer bias control portion 204.

The air blown history of a certain sheet is apparent from the time the sheets are placed in the paper deck and the current sheet surface position, and thus the application bias in the secondary transfer portion can be controlled and satisfactory transferability can be obtained.

The air received time one sheet receives air from the air blowing fan 417, the air pressure and the air temperature are detected, and the transfer bias is changed based on such detected information in the present embodiment. However, the transfer bias corresponding to the moisture content of the sheet may be set by changing the transfer bias in the secondary transfer portion according to at least one of the air received time, the air pressure and the air temperature.

Second Embodiment

The apparatus according to the second embodiment will now be described with reference to FIGS. 9 to 12. The basic configuration of the apparatus of the present embodiment is the same as the embodiment described above, and thus description will not be repeated, and characteristic configuration of the present embodiment will be described. The same reference numerals are denoted for members having the same function as the embodiment described above.

Figure 9A:
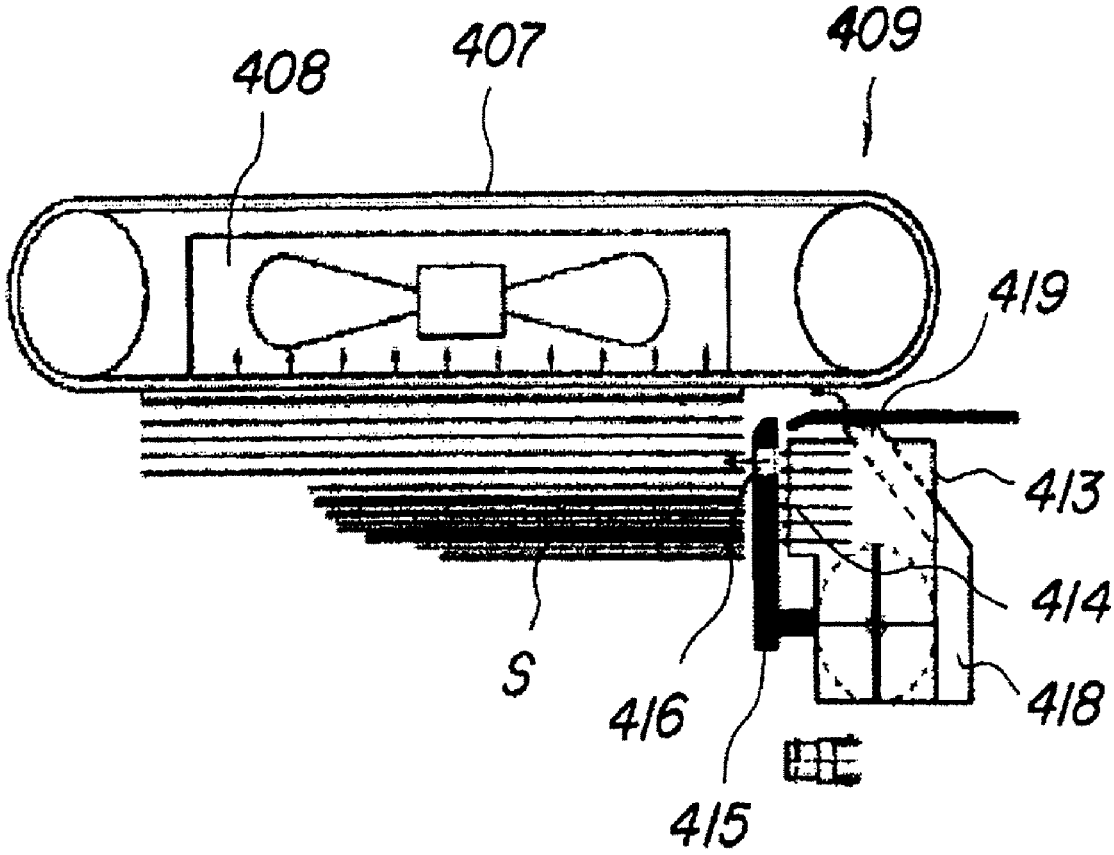
FIGS. 9A and 9B are simplified cross sectional views illustrating a paper deck.
Figure 9B:
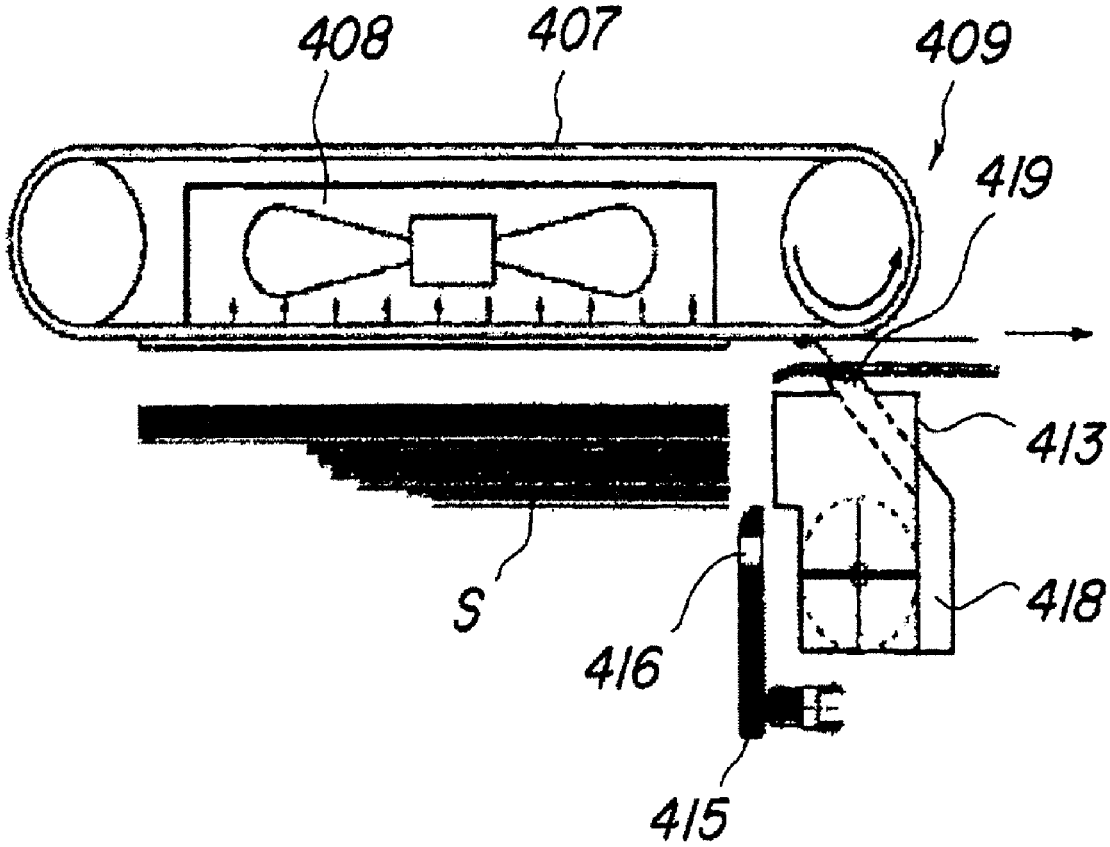

In the present embodiment, the blowing duct 413 and the vertically movable shutter 415 are arranged on the front end side of the sheet in the sheet feeding direction (end of the downstream side in sheet feeding direction), as shown FIGS. 9A and 9B.

A separation nozzle 419 is arranged at a separation duct 418 connected to the separation fan (not shown), and the separation air is supplied diagonally towards the absorbing belt 407 by the separation nozzle 419. The separation air effectively acts to make only the top sheet absorb to the absorbing belt 407, and separate and drop the subsequent sheets.

The air pressure of the present embodiment is 400 Pa, the air temperature is 25° C., and the number of sheets (plain paper having basis weight of 80 g) used in the present embodiment that float by air is twenty. The air is blown to the sheet stack for two seconds to feed one sheet.

Figure 10:
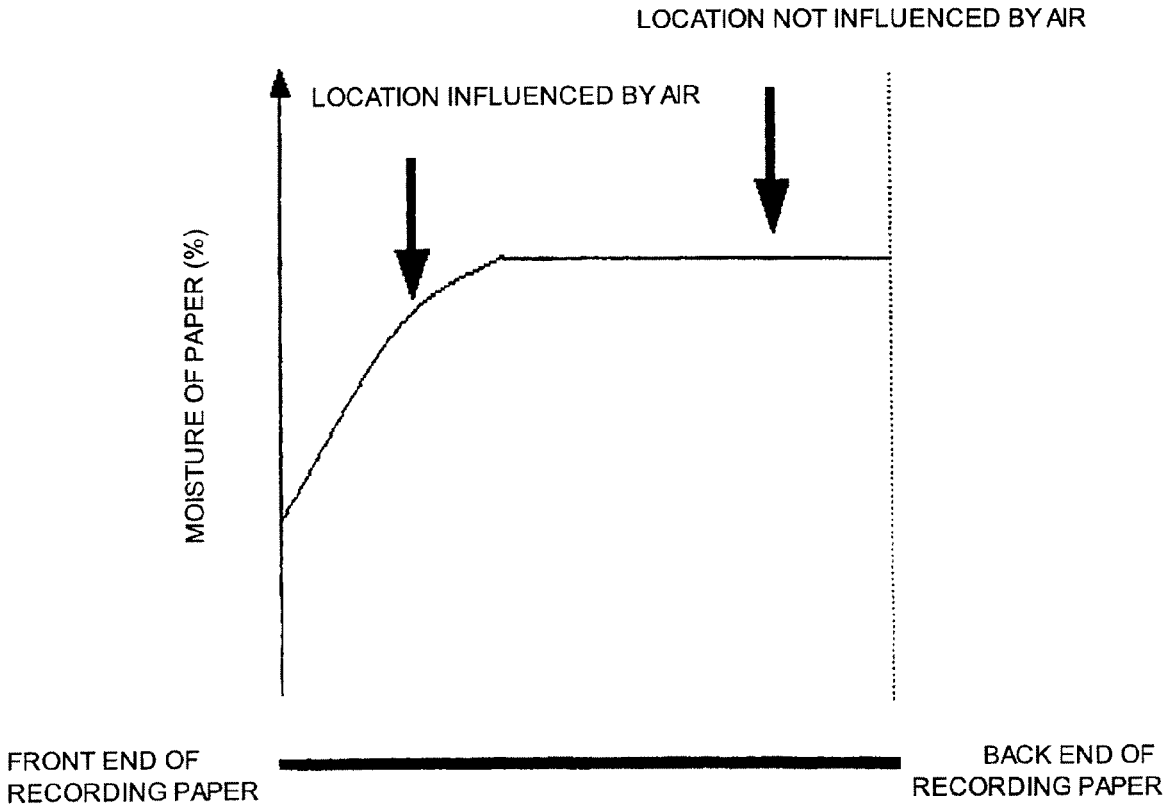
FIG. 10 is a simplified view illustrating the relationship of the moisture content distribution of the sheet.

In the present embodiment, the blowing duct 413 and the vertically movable shutter 415 as well as the separation nozzle for supplying separation air are arranged at the front end side of the sheet stack in the sheet feeding direction. Thus, lowering in the moisture content at the front end side of the sheet stack blown with air of the stacked sheets is significant, and moisture content at the back end side of the sheet stack (end on upstream side in sheet feeding direction) is rarely changed, as shown in FIG. 10. Therefore, the image defect is produced by mismatch of the bias applied in the secondary transfer portion T2 up to the location where the moisture content lowers due to the blown air from the front end side of the sheet stack.

An even transfer property is obtained within the area of the sheet by increasing the application bias from the front end side of the sheet stack to the location where the moisture content lowers by the influence of the air, and not adding correction value to the divided voltage Vp of the sheet on the back end side of the sheet stack not influenced by air.

Figure 11:
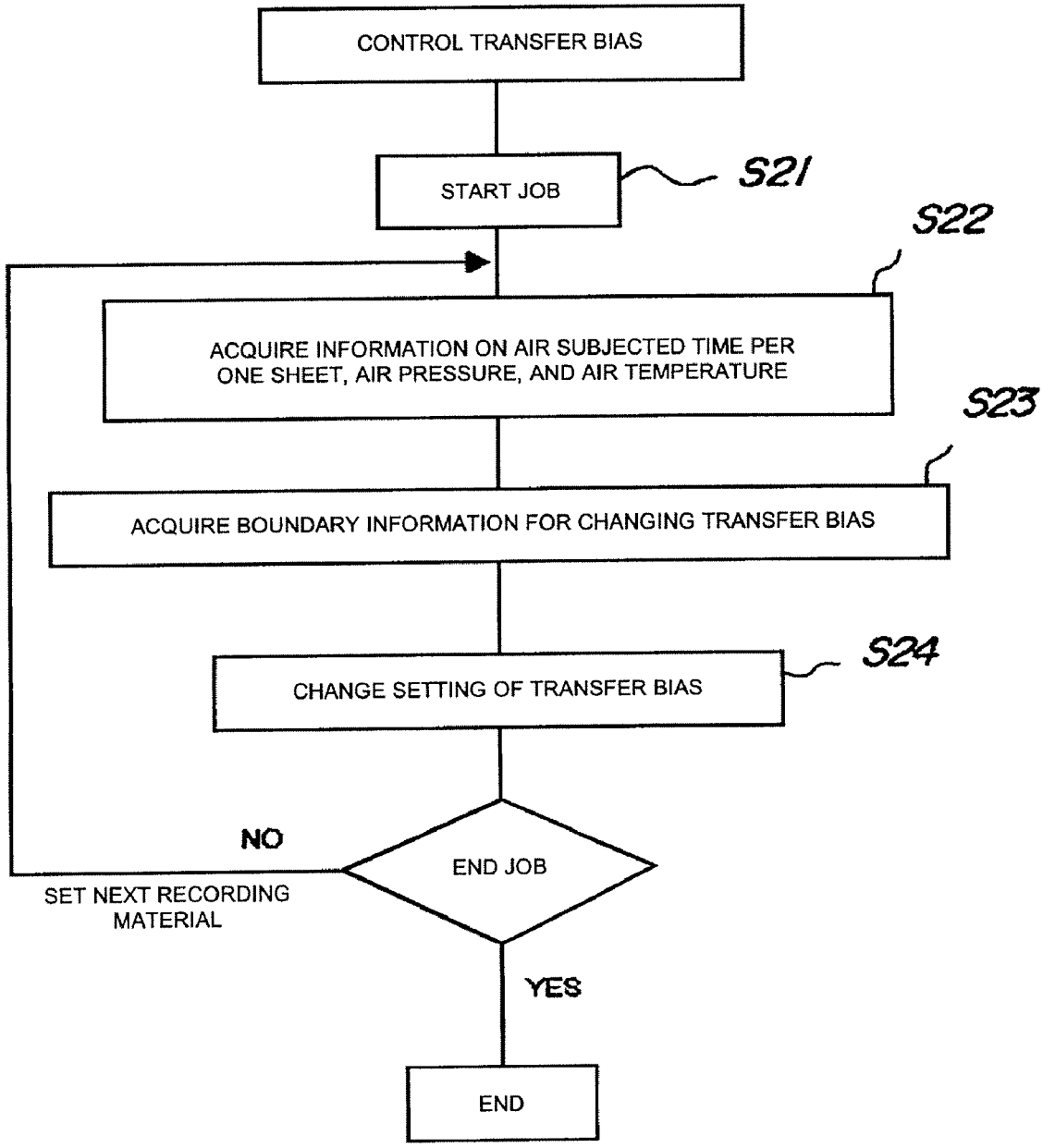
FIG. 11 is a control flow chart for changing the transfer bias.

Specifically, as shown in FIG. 11, when the job of image recording is started (S21), information on the air received time per one sheet blown with air by the blowing fan 417, air pressure, and air temperature are acquired (S22). The information on the boundary region for changing the secondary transfer bias is also acquired (S23). The boundary region may be set in advance in association with air pressure. The correction value to be added to the divided voltage Vp of the sheet is determined based on such information, and the secondary transfer bias value is changed (S24). The production of image defect is prevented since the secondary transfer bias having a value suited to the moisture content of the sheet is applied.

This will be described using specific numerical values. The air received time per one sheet and change in moisture content in continuous paper passing, and the set value of the application bias of the secondary transfer portion are values shown in FIG. 10, similar to the first embodiment. As shown in FIG. 10, the secondary transfer bias to be applied to the location (based on boundary region information acquired in step S23) the moisture content significantly lowers at the front end side of the sheet stack of sheet, is changed with change in moisture content. The secondary transfer bias to be applied to the location where the moisture content does not change at the back end side of the sheet stack of the sheet is not changed.

A large difference in bias between the location of changing the transfer bias and the location of not changing the transfer bias is created, but the concentration step difference created when the secondary transfer bias is switched within the area is eliminated by changing the bias value in five steps. Thus, an appropriate bias can be applied to each sheet having different air received time.

Figure 12:
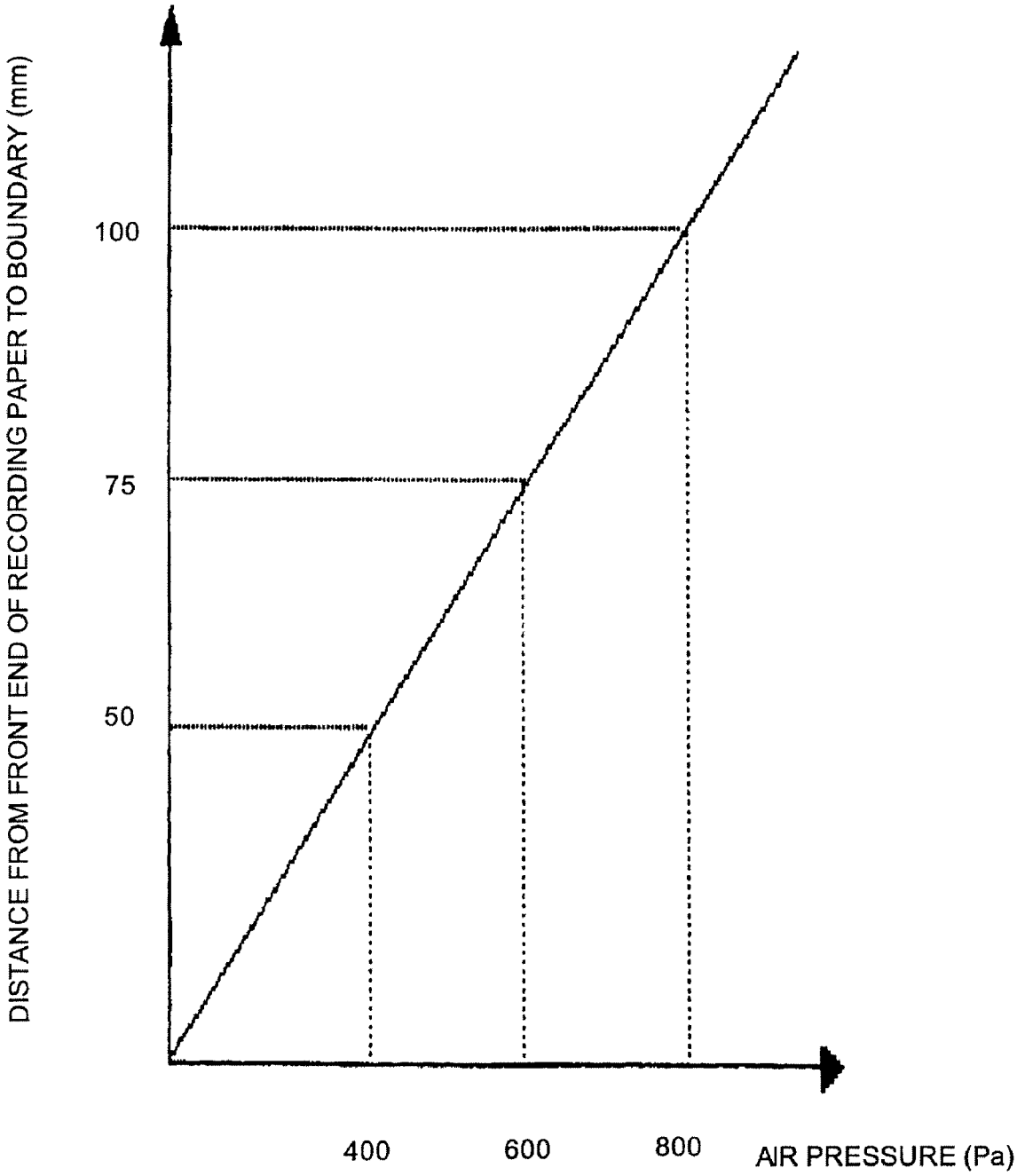
FIG. 12 is a graph illustrating air pressure and boundary of bias switching.

For example, a case of plain paper having basis weight of 80 g in which the air pressure is 400 Pa, the air temperature is 25° C. and the air received time is 40 seconds will be described. The air blowing time for feeding one sheet is assumed as two seconds. The bias from the front end side of the sheet stack to the location where the moisture content lowers by the influence of air is raised by 400V while being subjected to air for 20 seconds, as seen from FIG. 10. The bias (each bias switched at 50 mmsec) is lowered every 80V (=400V/5) in five steps at the boundary of location where the moisture content lowers and the location where the moisture content does not lower. An even transferability is thereby obtained in the area without concentration difference. The switching boundary in the present embodiment is the position of 50 mm from the front end of the sheet. The boundary is controlled in the control portion for every air pressure, as shown in FIG. 12.

The air pressure, the air received time per one sheet and the number of floating sheets, that is, the sheets influenced by air during the job have, in advance, set values in the control portion with respect to the device environment and the types of sheets.

The bias is changed in five steps in the present embodiment, but may be any number of steps as long as the concentration difference is eliminated. An example when sheets similar to the above are used will be described below. In the present embodiment, the air pressure is controlled with the rotation number of the fan, and the air received time per one sheet is adjusted by the height of the shutter.

The change in secondary transfer bias value when the air pressure and the air received time received by the stacked sheets are changed when other types of sheets are used will now be specifically described.

(1) When air at Temperature of 25° C. is Blown at Air Pressure of 600 Pa to Plain Paper Having Basis Weight of 209 g The number of floating sheets is assumed to be ten. The air blowing time for feeding one sheet is assumed to be two seconds.

The air received time of one sheet is accumulated every two seconds. The application bias in the secondary transfer portion is added by 30V each time the air received time increases two seconds to correspond to the change in moisture content. The boundary of the location where the moisture content lowers and the location where the moisture content does not lower is the position of 75 mm from the front end of the sheet, as seen from FIG. 12, and the mismatch of the application bias is suppressed by lowering the bias every ΔV total (=(air received time/2 sec)×30V)/5) in five steps at the boundary.

(2) When air temperature of 25° C. is blown at air pressure of 800 Pa to coated paper having basis weight of 209 g The number of floating sheets is assumed to be ten. The air blowing time for feeding one sheet is assumed to be two seconds.

The air received time of one sheet is accumulated every two seconds. The application bias in the secondary transfer portion is added by 40V each time the air received time increases two seconds to correspond to the change in moisture content. The boundary of the location where the moisture content lowers and the location where the moisture content does not lower is the position of 75 mm from the front end of the sheet, as seen from FIG. 12, and the mismatch of the application bias is suppressed by lowering the bias every ΔV total (=(air received time/2 sec)×40V)/5) in five steps at the boundary.

Therefore, the image without transfer defect across the entire sheet is obtained by changing the secondary transfer bias only at the location where the moisture content of the sheet is lowered when blown with air.

The time of blowing air to feed one sheet is fixed and the air pressure is changed according to the types of sheet in the present example, but the configuration of the present example is applicable to when the air pressure is fixed and the time of blowing air is changed according to the types of sheet.

Third Embodiment

The apparatus according to the third embodiment will now be described with reference to FIGS. 13A and 13B and table 5. Table 5 is a simplified table showing the relationship of temperature and air received time. The basic configuration of the apparatus of the present embodiment is the same as the embodiments described above, and thus description will not be repeated, and characteristic configuration of the present embodiment will be described. The same reference numerals are denoted for members having the same function as the embodiment described above.

Figure 13A:
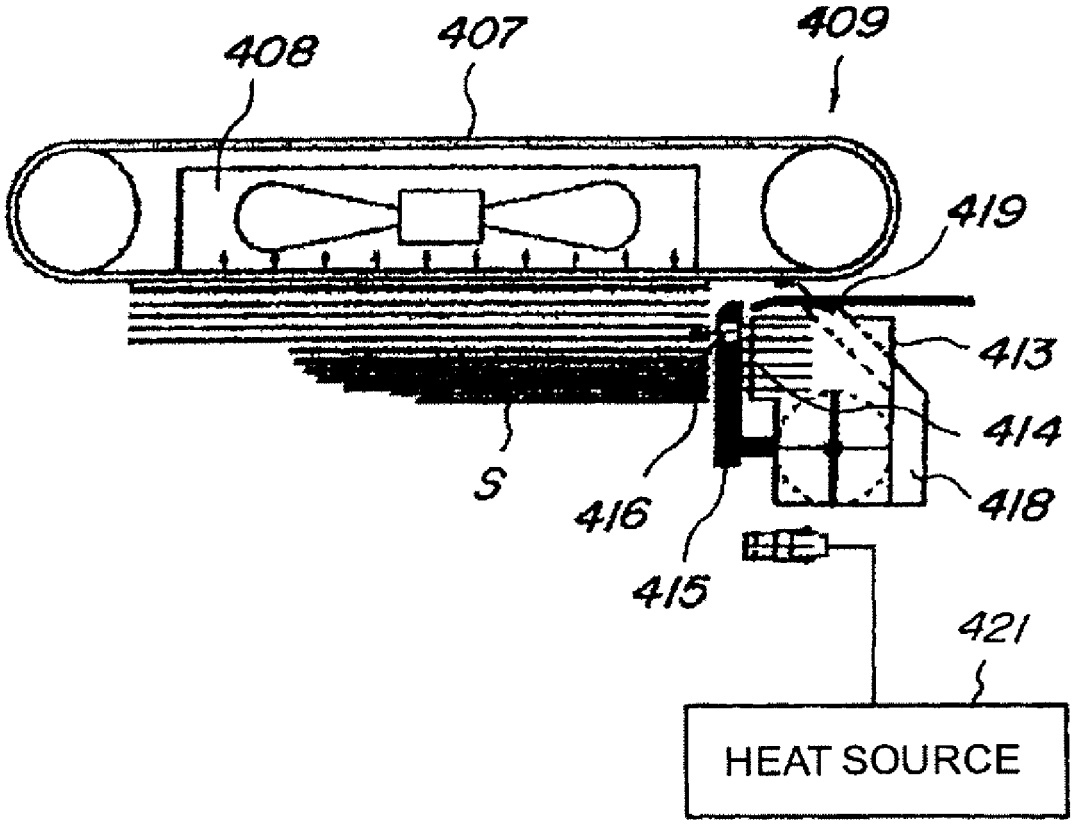
FIGS. 13A and 13B are simplified cross sectional views illustrating a paper deck arranged with a heater.
Figure 13B:
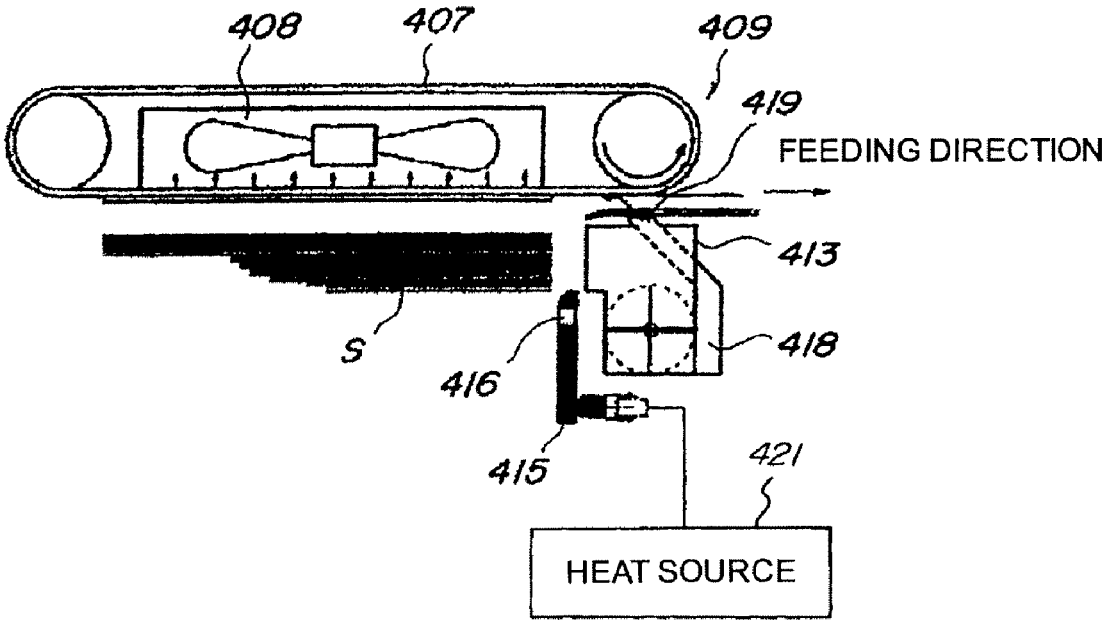

As shown in FIGS. 13A and 13B, a heat source 421 is arranged at the air blowing portion of the paper deck of the present embodiment. The temperature of the blowing air is adjusted by operating the heat source according to the temperature in the apparatus. When the air heated at the heat source 421 is blown against the sheet stack to dry the sheets, the attachment force between the sheets is reduced, and the sheet is stably fed.

The air pressure of the blowing air of the present embodiment is 400 Pa, and the number of sheets (plain paper of basis weight 80 g) used in the present embodiment that float by air (number of sheets subjected to air) is twenty (two seconds/sheet).

In the present embodiment, the temperature of the blowing air is 30° C. The air received time per one sheet and the change in moisture content in continuous sheet, and the set value of the application bias of the secondary transfer portion are shown in table 5. An appropriate bias can be applied to each sheet having different air received time by increasing the application bias of the secondary transfer portion by 30V every time the air received time per one sheet is increased by two seconds, as apparent from table 5. The transfer defect caused by mismatch of the transfer bias is thereby suppressed, and satisfactory transferability is obtained. Table 5 shows the case for air pressure of 400 Pa.

TABLE 5

| | | Air received time (sec.) | | |
|---|---|---|---|---|
| | | 2 | 3 | 4 |
| Temperature (° C.) | 30 | 30 V | 45 V | 60 V |
| | 40 | 40 V | 60 V | 80 V |
| | 50 | 50 V | 75 V | 100 V |

The air pressure, the air temperature, the air received time per one sheet and the number of floating sheets or sheets influenced by air during the job have, in advance, set values in the main body with respect to each environment and types of sheet.

The change in secondary transfer bias when the air temperature and the air received time are changed when the air pressure blown to the stacked sheets is 400 Pa will be specifically described using table 5.

(1) For Air Temperature of 40° C., Accumulation (air Blown for Two Seconds for Feeding One Sheet) of Air Received Time of Two Seconds/Air Pressure of 400 Pa/and Number of Floating Sheets of Ten The air received time received by one sheet is accumulated every two seconds. The mismatch of the application bias is suppressed by adding up the application bias in the secondary transfer portion by 40V each time the air received time increases two seconds to correspond to change in moisture content.

(2) For Air Temperature of 40° C., Accumulation (air Blown for Four Seconds for Feeding One Sheet) of Air Received Time of Four Seconds/Air Pressure of 400 Pa/Sheet (Number of Floating Sheets) of Ten The air received time received by one sheet is accumulated every four seconds. The mismatch of the application bias is suppressed by adding up the application bias in the secondary transfer portion by 80V each time the air received time increases four seconds to correspond to change in moisture content.

(3) For Air Temperature of 50° C., accumulation (air blown for Two seconds for aeeding One Sheet) of air Received Time of Two Seconds/Air Pressure of 400 Pa/and Number of Floating Sheets of Ten The air received time received by one sheet is accumulated every two seconds. The mismatch of the application bias is suppressed by adding up the application bias in the secondary transfer portion by 50V each time the air received time increases two seconds to correspond to change in moisture content.

Therefore, the secondary transfer bias is changed to be higher as the temperature of the blowing air becomes higher since the reduction in the moisture content of the sheet is large even with the same air received time. The image without transfer defect is thereby obtained.

Example 4

The apparatus according to the fourth embodiment will now be described with reference to FIGS. 14 and 15. The basic configuration of the apparatus of the present embodiment is the same as the embodiments described above, and thus description will not be repeated, and characteristic configuration of the present embodiment will be described. The same reference numerals are denoted for members having the same function as the embodiments described above.

The sheets are affected by air in the paper deck 401, and the moisture content of the sheets lowers. In particular, when the location where the change in curled amount is large is at the back end of the secondary transfer portion, region 1) of FIGS. 14A to 14C have a possibility of lowering transferability due to mismatch of transfer bias and producing defected image (transfer defect) if the same transfer bias is applied during the secondary transfer, as shown in FIG. 14B. In region 2) the curled amount gradually changes, as shown in FIG. 14C. The discharging property thereby varies, and thus the image defect caused by discharge unevenness may occur due to mismatch of the transfer bias.

The transfer bias to be applied to the secondary transfer roller 140 in the secondary transfer portion T2 is increased (absolute value, to be hereinafter expressed in the same manner) in region 1) of FIG. 14A, with lowering in the moisture content and increase in the curled amount in the present embodiment in order to suppress image defect. The transfer bias to be applied to the secondary transfer roller 140 is sequentially lowered in region 2) of FIG. 14A. Specifically, when the job of image recording is started (S1), information on the air received time per one sheet blown with air by the blowing fan 417, the air pressure, the air temperature, and types of sheet are acquired (S2), as shown in FIG. 15. In region 1) of FIG. 14A, the transfer bias is increased by adding the correction value to the divided voltage Vp of the sheet based on such information. In region 2) of FIG. 14A, the transfer bias is sequentially lowered by subtracting the correction value from the transfer bias to be applied to 1) of FIG. 14A (S3). The secondary transfer bias having a value suited to the moisture content of sheet is applied and the production of image defect is prevented.

Specific examples of the values of the transfer bias in the secondary transfer portion of regions 1) and 2) of FIG. 14A when the air pressure of the blowing fan 417 and the air received time are changed in the image forming apparatus of the present embodiment will now be described using tables 6 to 8. Tables 6 to 8 are tables showing the relationship between the air pressure, the air received time, the curled amount and the correction value.

TABLE 6

| | | Air received time (sec.) | | | | |
|---|---|---|---|---|---|---|
| | | 2 | 3 | 4 | . . . | 20 |
| Air pressure (Pa) | 400 | 20 V | 30 V | 40 V | . . . | 200 V |
| | 600 | 30 V | 45 V | 60 V | . . . | 300 V |
| | 800 | 40 V | 60 V | 80 V | . . . | 400 V |

TABLE 7

| | | Air received time (sec.) | | | | |
|---|---|---|---|---|---|---|
| | | 2 | 3 | 4 | . . . | 20 |
| Air pressure (Pa) | 400 | 0.50 mm | 0.60 mm | 0.70 mm | . . . | 2.30 mm |
| | 600 | 0.70 mm | 0.85 mm | 1.00 mm | . . . | 3.40 mm |
| | 800 | 0.90 mm | 1.10 mm | 1.30 mm | . . . | 4.50 mm |

TABLE 8

| Curled amount | Lowered voltage |
|---|---|
| 0.0 mm | 0 V |
| 0.2 mm | 25 V |
| 0.4 mm | 50 V |
| 0.6 mm | 75 V |
| 0.8 mm | 100 V |
| 1.0 mm | 125 V |
| . . . mm | . . . V |
| 3.4 mm | 425 V |
| 3.6 mm | 450 V |
| 3.8 mm | 475 V |
| 4.0 mm | 500 V |
| . . . mm | . . . V |
| 9.4 mm | 1175 V |
| 9.6 mm | 1200 V |
| 9.8 mm | 1225 V |
| 10.0 mm | 1250 V |

The air pressure by the blowing fan 417 is 400 Pa and the temperature is 25° C. in the image forming apparatus of the present embodiment. The number of sheets (plain paper with basis weight 80 g) used in the present embodiment that floats (number of sheets subjected to air) by air is twenty (two sec/sheet).

Figure 14A:
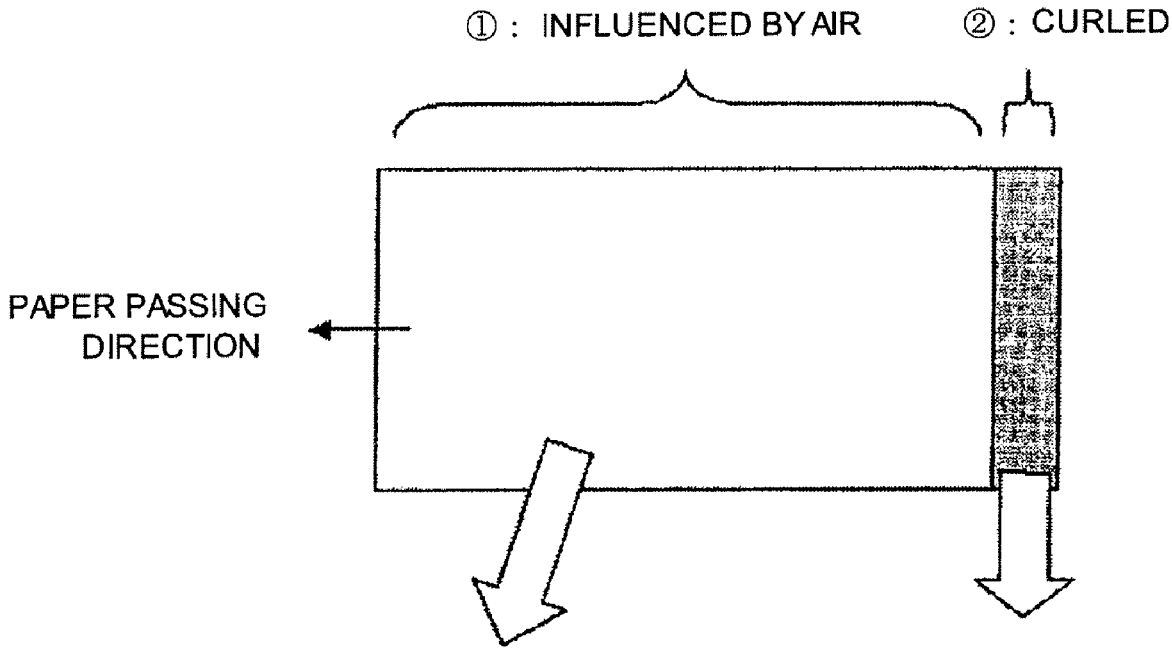
FIGS. 14A to 14C are view illustrating the production states of transfer defect and curls of the recording material.
Figure 14B:
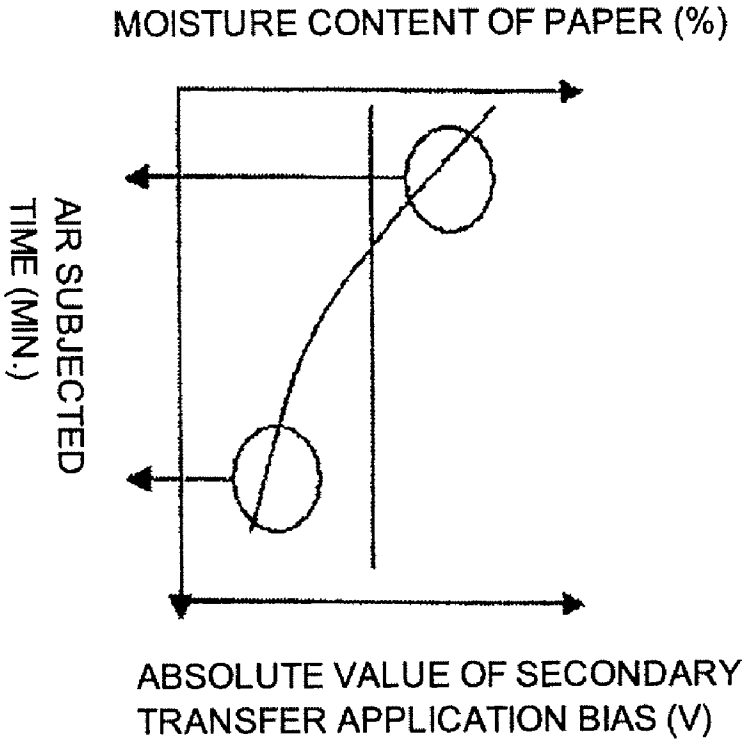
Figure 14C:
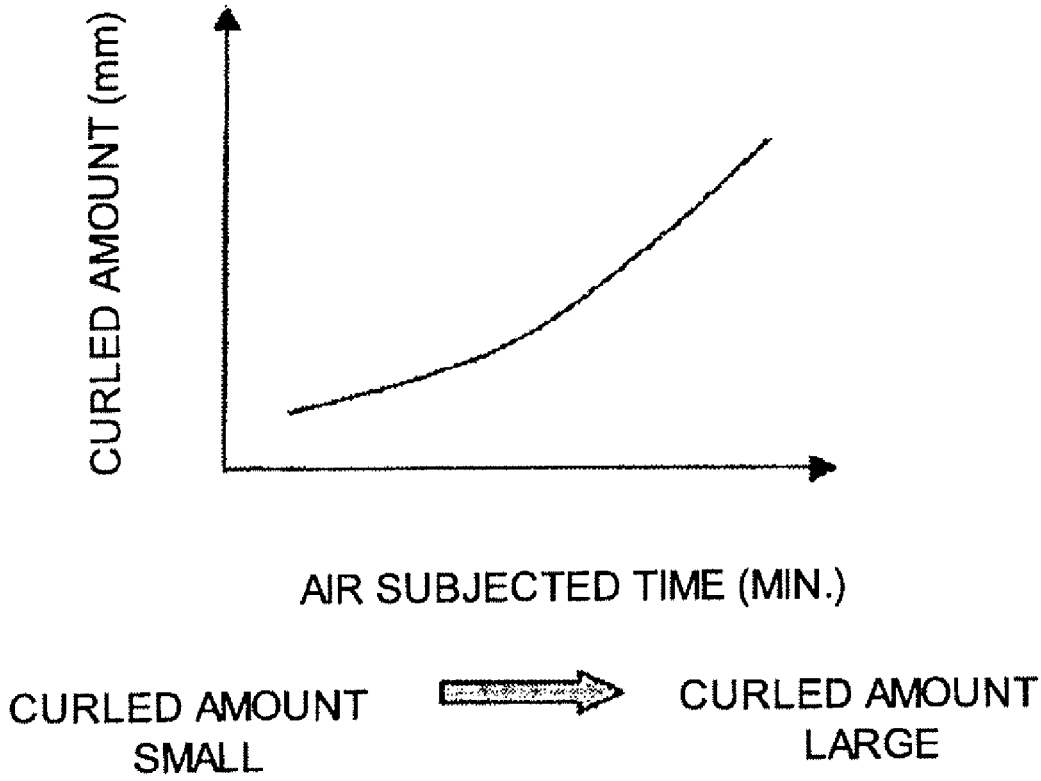

As shown in table 6, an appropriate bias is applied to each sheet having different air received time by increasing the transfer bias of region 1) of FIG. 14A by 20V each time the air received time per one sheet increases two seconds.

Furthermore, the curled amount of region 2) of FIG. 14A increases by 0.2 mm when the air received time increases two seconds (see table 7). Therefore, the transfer bias applied to region 2) of FIG. 14A is a value lowered by 25V each time the air received time increases two seconds from the transfer bias (value obtained by adding correction value to divided voltage Vp) to be applied to region 1) of FIG. 14A (see table 8). According to such control, the transfer defect caused by mismatch of transfer bias is reduced, and satisfactory transferability is obtained.

The air pressure, the air received time per one sheet and the number of floating sheets, that is, the sheets influenced by air during the job have, in advance, set values in the main body with respect to each environment and types of sheet.

When the sheet similar to the above is used, the secondary transfer bias values of regions 1) and 2) of FIG. 14A are changed when the air pressure received by the stacked sheets is changed.

(1) For Air Pressure of 600 Pa, Accumulation of Air received time of two seconds/air temperature of 25° C./number of floating sheets of ten The air received time received by one sheet is accumulated every two seconds. The application bias in the secondary transfer portion of region 1) of FIG. 14A is added up by 30V each time the air received time increases two seconds to correspond to change in moisture content. The transfer bias to be applied to region 2) of FIG. 14A is a value lowered by 37.5V each time the air received time increases two seconds from the transfer bias (value obtained by adding correction value to divided voltage Vp) to be applied to region 1) of FIG. 14A (see table 8).

(2) For air pressure of 600 Pa, accumulation of air Received Time of Four Seconds/Air Temperature of 25° C./Number of floating sheets of twenty The air received time received by one sheet is accumulated every four seconds. The transfer bias to be applied to region 1) of FIG. 14A is added by 60V each time the air received time increases four seconds to correspond to change in moisture content.

The transfer bias to be applied to region 2) of FIG. 14A is a value lowered by 75V each time the air received time increases two seconds from the transfer bias (value obtained by adding correction value to divided voltage Vp) to be applied to region 1) of FIG. 14A (see table 8).

(3) For air pressure of 800 Pa, accumulation of air received time of two seconds/air temperature of 25° C./number of floating sheets of ten The air received time received by one sheet is accumulated every two seconds. The transfer bias to be applied to region 1) of FIG. 14A is added by 40V each time the air received time increases two seconds to correspond to change in moisture content.

The transfer bias to be applied to region 2) of FIG. 14A is a value lowered by 50V each time the air received time increases two seconds from the transfer bias (value obtained by adding correction value to divided voltage Vp) to be applied to region 1) of FIG. 14A (see table 8).

Example 5

The apparatus according to the fifth embodiment will now be described with reference to FIGS. 14 and 15, and tables 9 and 10. The basic configuration of the apparatus of the present embodiment is the same as the embodiments described above, and thus description will not be repeated, and characteristic configuration of the present embodiment will be described. The same reference numerals are denoted for members having the same function as the embodiments described above.

Similar to example 4, the transfer bias to be applied to the back end of the sheet is made small in consideration of the curls of the sheet in the present example, but a case of changing the air temperature will be described in the present example.

Figure 15:
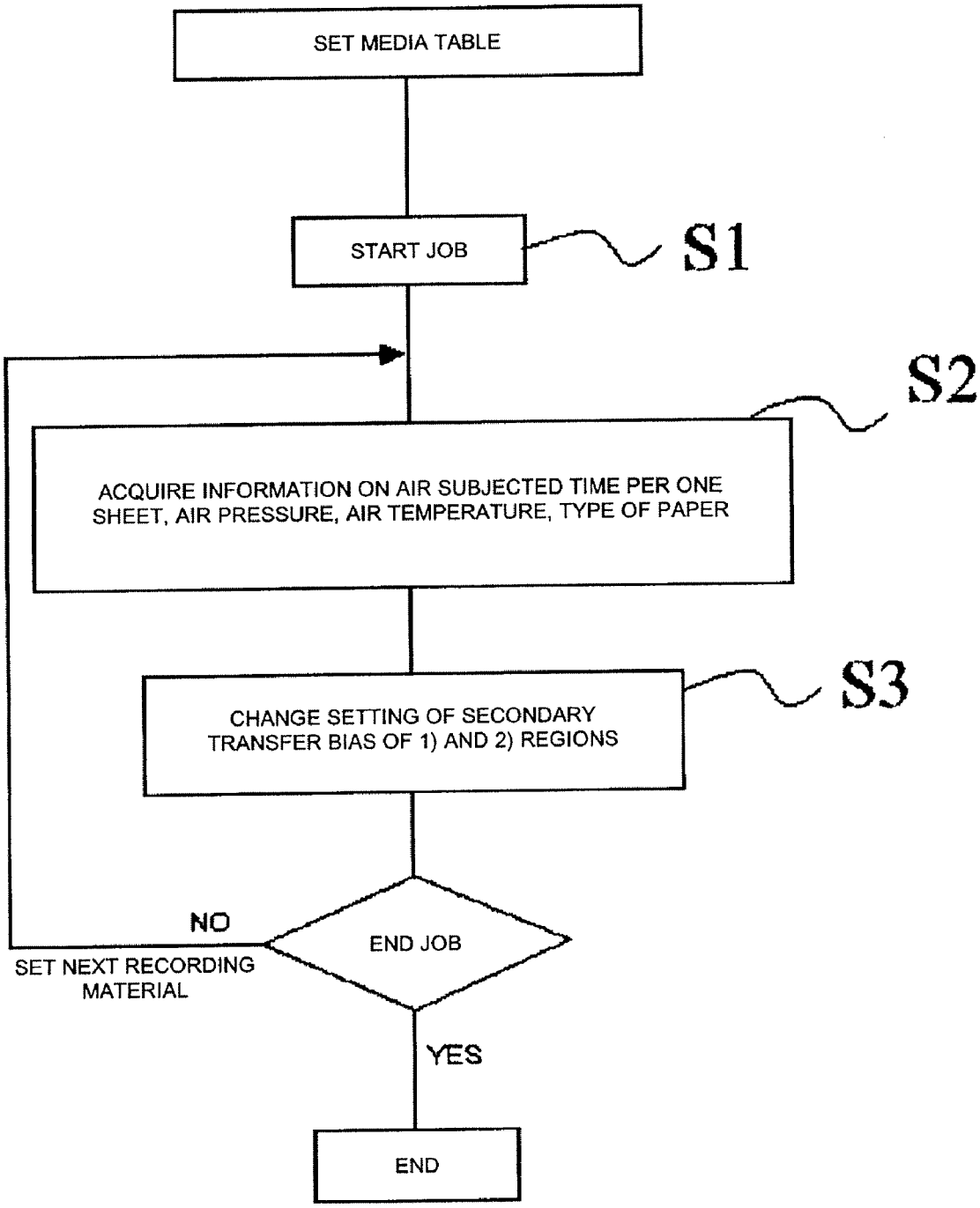
FIG. 15 is a control flow chart for changing the transfer bias in examples 4 and 5.

The method of controlling the transfer bias follows the flowchart of FIG. 15, similar to example 4.

Specific examples of the transfer bias of regions 1) and 2) of FIG. 14A according to the air temperature and air received time by the blowing fan 417 in the image forming apparatus of the present embodiment will now be described using tables 9 to 10. Tables 9 and 10 are tables showing the relationship of the air temperature, the air received time, the curled amount and the correction value.

TABLE 9

| | | Air received time (sec.) | | | | |
|---|---|---|---|---|---|---|
| | | 2 | 3 | 4 | ... | 20 |
| temperature (° C.) | 30 | 30 V | 40 V | 50 V | ... | 220 V |
| | 40 | 40 V | 60 V | 80 V | ... | 420 V |
| | 50 | 50 V | 75 V | 100 V | ... | 525 V |

TABLE 10

| | | Air received time (sec.) | | | | |
|---|---|---|---|---|---|---|
| | | 2 | 3 | 4 | ... | 20 |
| temperature (° C.) | 30 | 0.60 mm | 0.75 mm | 0.90 mm | ... | 3.45 mm |
| | 40 | 0.90 mm | 1.10 mm | 1.30 mm | ... | 4.70 mm |
| | 50 | 1.10 mm | 1.35 mm | 1.60 mm | ... | 5.85 mm |

The air pressure by the blowing fan 417 is 400 Pa in the image forming apparatus of the present embodiment. First, a case when the air temperature is 30° C. will be described. The number of sheets (plain paper, basis weight 80 g) used in the present embodiment that floats by air is twenty.

As shown in table 9, appropriate bias can be applied to the each sheet having different air received time by increasing the transfer bias to be applied to region 1) of FIG. 14A by 30V each time the air received time per one sheet increases two seconds. In this case, the curled amount of region 2) of FIG. 14A increases by 0.3 mm (see table 8).

Therefore, the transfer bias to be applied to region 2) of FIG. 14A is a value lowered by 37.5V (intermediate value of 25V when curled amount is 0.2 mm and 50V when curled amount is 0.4 mm) each time the air received time increases two seconds from the transfer bias (value obtained by adding correction value to divided voltage Vp) to be applied to region 1) of FIG. 14A (see table 8).

The air pressure, air received time per one sheet, and number of sheets that float or sheets influenced by air during the job have, in advance, set values in the main body with respect to each environment and types of sheet.

The secondary transfer bias value of regions 1) and 2) of FIG. 14A changes when the air temperature received by stacked sheets changes.

(1) for Air Temperature of 40° C., Accumulation of Air Received Time of Two Seconds/Air Pressure of 400 Pa/Number of Floating Sheets of Ten The air received time received by one sheet is accumulated every two seconds. The application bias in the secondary transfer portion of region 1) of FIG. 14A is added by 40V each time the air received time increases two seconds to correspond to change in moisture content. The transfer bias to be applied to region 2) of FIG. 14A is a value lowered by 50V each time the air received time increases two seconds from the transfer bias (value obtained by adding correction value to divided voltage Vp) to be applied to region 1) of FIG. 14A (see table 8).

(2) for air temperature of 40° C., accumulation of air received time of four seconds/air pressure of 400 Pa/sheet (Number of Floating Sheets) of Twenty The air received time received by one sheet is accumulated every four seconds. The transfer bias to be applied to region 1) of FIG. 14A is added by 80V each time the air received time increases four seconds to correspond to change in moisture content.

The transfer bias to be applied to region 2) of FIG. 14A is a value lowered by 100V each time the air received time increases four seconds from the transfer bias (value obtained by adding correction value to divided voltage Vp) to be applied to region 1) of FIG. 14A (see table 8).

(3) For air temperature of 50° C., accumulation of air received time of two seconds/sheet (number of floating sheets) of ten The air received time received by one sheet is accumulated every two seconds. The transfer bias to be applied to region 1)

of FIG. 14A is added by 50V each time the air received time increases two seconds to correspond to change in moisture content.

The transfer bias to be applied to region 2) of FIG. 14A is a value (intermediate value of 75V when curled amount is 0.6 mm and 100V when curled amount is 0.8 mm) lowered by 87.5V each time the air received time increases four seconds from the transfer bias (value obtained by adding correction value to divided voltage Vp) to be applied to region 1) of FIG. 14A (see table 8).

Other Embodiments

In the image forming apparatus for directly transferring the toner image on the photosensitive drum to the sheet and forming the image, the transfer bias may be changed according to at least one of the air received time of the blowing air received by the stacked sheets, the air pressure, and the air temperature.

This application claims the benefit of priority from the prior Japanese Patent Application No. 2006-094188 filed on Mar. 30, 2006 the entire contents of which are incorporated by reference herein.

What is claimed is:

1. An image forming apparatus comprising:

an image bearing member which bears a toner image;

a transfer unit which transfers the toner image on the image bearing member to a recording material in a transfer portion when applied with transfer bias;

a recording material feeding unit which includes (i) a stacking portion where recording materials are stacked and (ii) an air blowing unit for blowing air to a plurality of recording materials stacked in the stacking portion, the recording material feeding unit separating the stacked recording materials by blowing air to the recording materials and feeding one of the recording materials to the transfer portion; and a transfer bias changing means which changes a transfer bias within an area of a recording material according to a state of the air blowing when the recording material, on which a state of the air blowing is different, passes the transfer portion.

2. The image forming apparatus according to claim 1, wherein the air blowing unit changes one of the time for blowing air to the recording materials and the air pressure to be blown to the recording material according to the type of sheet.

3. The image forming apparatus according claim 1, wherein the air blowing unit blows air towards the recording material from the end of the downstream side in the feeding direction of the recording material stacked in the stacking portion, and wherein the transfer bias changing means changes the transfer bias so that the transfer bias when the front end of the recording material in the feeding direction passes the transfer portion and the transfer bias when the back end of the recording material in the feeding direction passes through the transfer portion are different.

4. The image forming apparatus according to claim 1, wherein the state of the air blowing is decided by the time for blowing air to the recording materials.

5. The image forming apparatus according to claim 1, wherein the state of the air blowing is decided by a pressure of the air to be blown to the recording materials by the air blowing unit.

6. The image forming apparatus according to claim 1, wherein the state of the air blowing is decided by a temperature of the air to be blow to the recording materials by the air blowing unit.

* * * * *